US006065957A

United States Patent [19]

Kondo et al.

[11] Patent Number: 6,065,957

[45] Date of Patent: May 23, 2000

[54] CATALYST COMBUSTION APPARATUS

[75] Inventors: Yasuo Kondo, Okazaki; Shinichi Mashimo, Kariya; Akio Matsuoka, Takahama; Masanori Uehara, Kariya, all of Japan

[73] Assignee: Denso Corporation, Japan

[21] Appl. No.: 09/115,676

[22] Filed: Jul. 15, 1998

Related U.S. Application Data

[63] Continuation-in-part of application No. 08/821,338, Mar. 20, 1997, abandoned.

[30] Foreign Application Priority Data

| | | | |
|---|---|---|---|
| Mar. 21, 1996 | [JP] | Japan | 8-64892 |
| Sep. 24, 1996 | [JP] | Japan | 8-251840 |
| Nov. 13, 1996 | [JP] | Japan | 8-301914 |
| Jul. 17, 1997 | [JP] | Japan | 9-192926 |

[51] Int. Cl.[7] ..... F23L 13/00

[52] U.S. Cl. ..... 431/116; 431/7; 431/208; 431/215; 431/350

[58] Field of Search ..... 431/7.9, 115, 116, 431/215, 170, 208, 326, 328, 350, 353

[56] References Cited

U.S. PATENT DOCUMENTS

| | | | |
|---|---|---|---|
| 4,435,153 | 3/1984 | Hashimoto et al. | 431/215 |
| 5,203,690 | 4/1993 | Maruko | 431/170 |
| 5,346,389 | 9/1994 | Retallick et al. | 431/170 |
| 5,388,985 | 2/1995 | Musil et al. | 431/116 |
| 5,431,017 | 7/1995 | Kobayashi et al. | 431/170 |

FOREIGN PATENT DOCUMENTS

| | | |
|---|---|---|
| 60-30908 | 2/1985 | Japan . |
| 4-320710 | 11/1992 | Japan . |
| 5-71712 | 3/1993 | Japan . |
| 5-187623 | 7/1993 | Japan . |

*Primary Examiner*—James C. Yeung
*Attorney, Agent, or Firm*—Nixon & Vanderhye PC

[57] ABSTRACT

According to the present invention, a catalyst combustion apparatus includes a ring-shaped catalyst body for catalytically burning the mixture of the fuel and the air, which is disposed in a combustion cylinder. In the combustion cylinder, a fuel nozzle and an inlet for the air are disposed at one end side of the catalyst body, and the premixing chamber is formed at the other end side. The fuel and the air are supplied from one end side of the catalyst body through a through-hole formed at a center portion of the catalyst body and is mixed in the premixing chamber. In the premixing chamber, a flow direction of the mixture is turned toward the catalyst body. A part of the exhaust gas is introduced into the air at one end side. In this way, it is possible to simplify and downsize the combustion apparatus, while securing the preheating effect of the air by the circulation of the exhaust gas.

34 Claims, 23 Drawing Sheets

CATALYST COMBUSTION APPARATUS

This application is a continuation-in-part of application Ser. No. 08/821,338, filed Mar. 20, 1997, abandoned.

CROSS REFERENCE TO THE RELATED APPLICATIONS

This application is based on and claims priority of Japanese Patent Application Nos. Hei. 8-64892 filed on Mar. 21, 1996, Hei. 8-251840 filed on Sep. 24, 1996, Hei. 8-301914 filed on Nov. 13, 1996, and Hei. 9-192926 filed on Jul. 17, 1997, the contents of which are incorporated herein by reference.

BACKGROUND OF THE INVENTION

1. Field of the Invention

The present invention relates to a catalyst combustion apparatus which is suitably employed in a heating system or a drying system.

2. Description of Related Art

A catalyst combustion apparatus is known which is equipped with fuel supply means for supplying fuel and air supply means for supplying air, and in which a mixture of fuel supplied by the fuel supply means and air supplied by the air supply means is burned by a catalyst. In this catalyst combustion apparatus, no flame is produced; and therefore, there is no, carbon generated. Moreover, the catalyst combustion apparatus can greatly suppress the exhaust emission at the time of ignition or extinguishment, as caused in a flame combustion, so that it is remarkably effective as a heating system for an electric vehicle, which desirably has clean exhaust gas.

In order to continue the catalyst combustion in the aforementioned catalyst combustion apparatus, it is necessary to always preheat the air for combustion to activate the catalyst. If such a preheating is performed by an electric heater, there is an increase electric power consumption. Thus, it is not suitable for an electric vehicle to use such an electric heater, due to the limited battery capacity.

If the air for combustion is preheated by a burner, carbon adheres to the catalyst so that the combustion efficiency of the catalyst may deteriorate. Moreover, at ignition, the catalyst is too cold to be sufficiently activated. Accordingly, there is the problem that the exhaust emission produced by the burner may be discharged as is.

In order to solve this problem, JP-A60-30908, there provides an exhaust gas circulation pipe for connecting between the upstream side and the downstream side of the catalyst combustion apparatus, and the air for combustion is preheated by circulating a part of the exhaust gas to the upstream side of the catalyst combustion apparatus.

JP-A-4-320710, on the other hand, provides a catalyst combustion apparatus in which the raw mixed gas of fuel and air, which is supplied to a gas passage in a catalyst layer, is accelerated by passing through an injection nozzle, so that a part of the exhaust gas may be circulated by a decompressing function due to the acceleration, and the raw mixed gas is preheated.

According to these conventional combustion apparatuses, the air for combustion can be preheated to stabilize the combustion without using any separate heating means such as an electric heater or a burner.

However, in the conventional apparatus disclosed in JP-A-60-30908, the combustion apparatus must be large-sized, because the exhaust gas circulation pipe is disposed outside the combustion apparatus. Accordingly, there is a problem in that it is difficult to mount the heating system on a vehicle having limited available space.

On the other hand, in the conventional apparatus disclosed in JP-A-4-320710, since it is necessary to mix the air and the fuel in advance, an additional device for mixing is required. In addition, a plurality of gas passages are formed in the catalyst layer, and the corresponding number of injection nozzles should be provided. Thus, the number of parts is inevitably increased, the construction is complicated, and the production cost is increased.

Also, although the catalyst combustion apparatus complies with clean requirement for the exhaust gas, the catalyst combustion apparatus may have a problem concerning exhaust gas emission in case the combustion amount is smaller than a specific amount. That is, when the combustion amount is decreased so that a ratio of heat loss (mainly caused by heat transfer by convection and radiation) relative to a calorific value generated by the combustion increases, the temperature inside the combustion apparatus is decreased to suppress activation of catalytic reaction. This may result in insufficient catalytic reaction, so that the exhaust gas emission increases.

SUMMARY OF THE INVENTION

The present invention has been conceived in view of the above-described problems and has an object to provide a catalyst combustion apparatus which has a small-sized and simplified construction while preheating the air for combustion by the circulation of the exhaust gas so that a satisfactory catalyst combustion is realized. Another object of the present invention is to provide a catalyst combustion apparatus which has a small-sized and simplified construction and is capable of realizing clean combustion even when a combustion amount is small.

According to the present invention, a ring-shaped catalyst body for catalytically burning a mixture of fuel and air is disposed in a combustion cylinder, and supply means for supplying the fuel and the air are disposed at one end side of the catalyst body whereas a premixing chamber for preparing a mixture of the fuel and the air is disposed at the other end side of the catalyst body. Moreover, the fuel and the air are mixed in a premixing chamber by supplying the fuel and the air from the one end side of the catalyst body through a through-hole formed at a central portion of the catalyst body. A flow direction of the mixture is turned in the premixing chamber such that the mixture flows through the catalyst body from the other end side to the one end side, and a part of the exhaust gas having passed through the catalyst body is circulated at one end side of the catalyst body into the air.

By circulating a part of the exhaust gas into the air to be burnt, the air can be preheated with the heat of the exhaust gas so that the catalyst can be activated by this preheating operation to stabilize the catalytic combustion continuously. Moreover, all mechanism for circulating the exhaust gas partially into the air can be disposed in the combustion cylinder so that the catalyst combustion apparatus can be downsized.

In the present invention, moreover, the fuel and the air makes U-turn in the premixing chamber, after having passed through the through-hole at the central portion of the ring-shaped catalyst body, such that the mixture flows through the catalyst body from the other end side to the one end side. As compared with the catalyst combustion apparatus equipped with the plurality passages for the catalytic layer gas and injection nozzles, the number of parts can be greatly reduced to simplify the construction and to reduce the manufacture cost of the catalyst combustion apparatus.

Preferably, the catalyst body is composed of a first catalyst member having the through-hole at the center thereof and a second catalyst member disposed on an outer circumferential side of the first catalyst member. In this case, the mixture first flows in the first catalyst member from the other end side to the one end side, and then flows in the second catalyst member from the one end side to the other end side. Accordingly, the mixture is burned in both of the first and second catalyst members. When a combustion amount is small, the catalytic reaction is almost finished in the first catalyst member. When the combustion amount is large, the unburned mixture is burned in the second catalyst member so that the catalytic reaction is completed. As a result, the catalyst combustion apparatus of the present invention can achieve a clean combustion even when the combustion amount is small.

BRIEF DESCRIPTION OF THE DRAWINGS

Additional objects and advantages of the present invention will be more readily apparent from the following detailed description of preferred embodiments thereof when taken together with the accompanying drawings in which.

Figure 23:
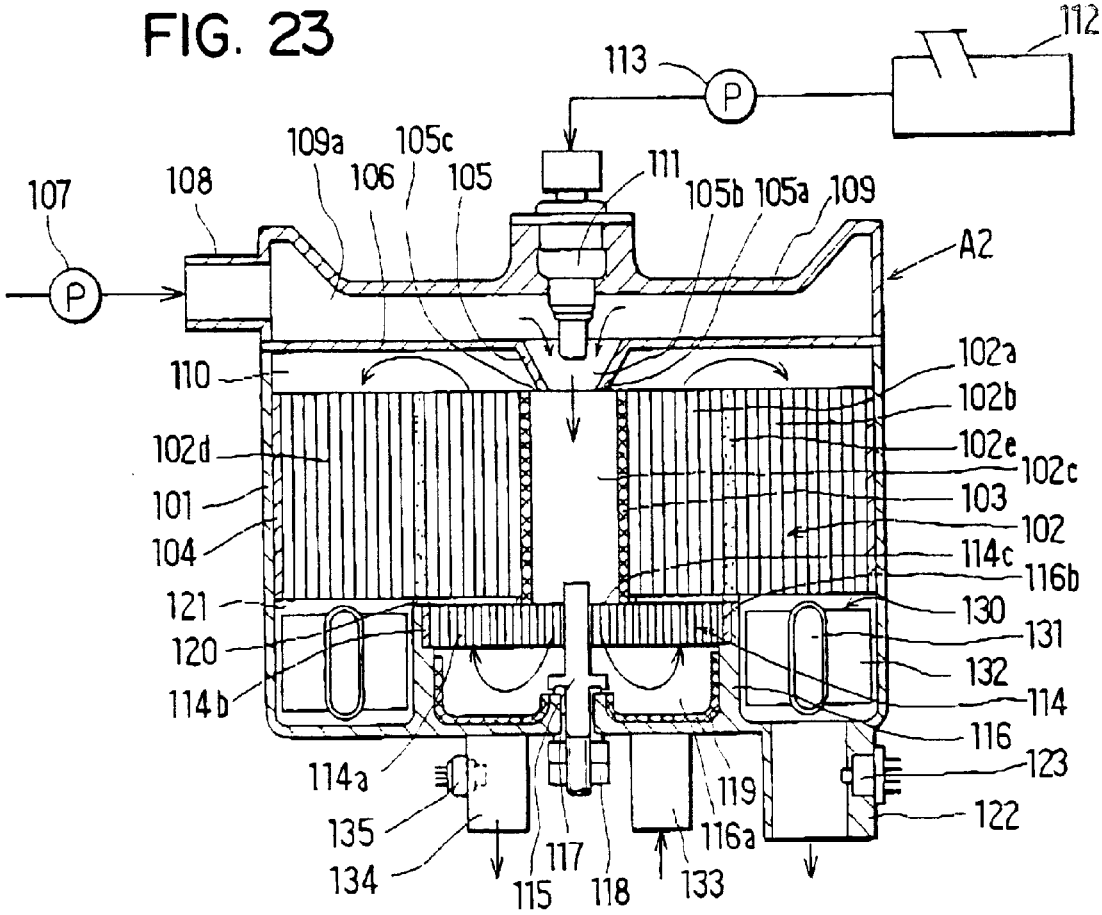
Figure 24:
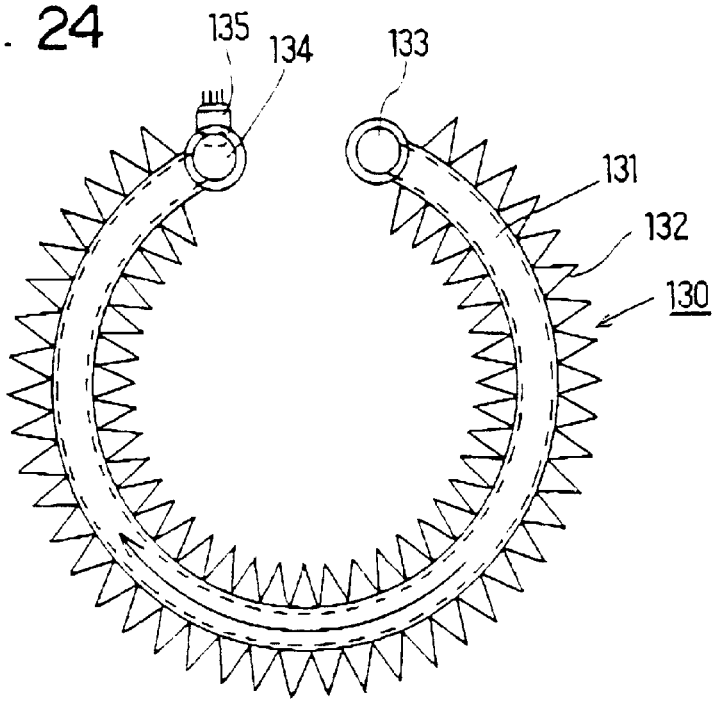
Figure 25:
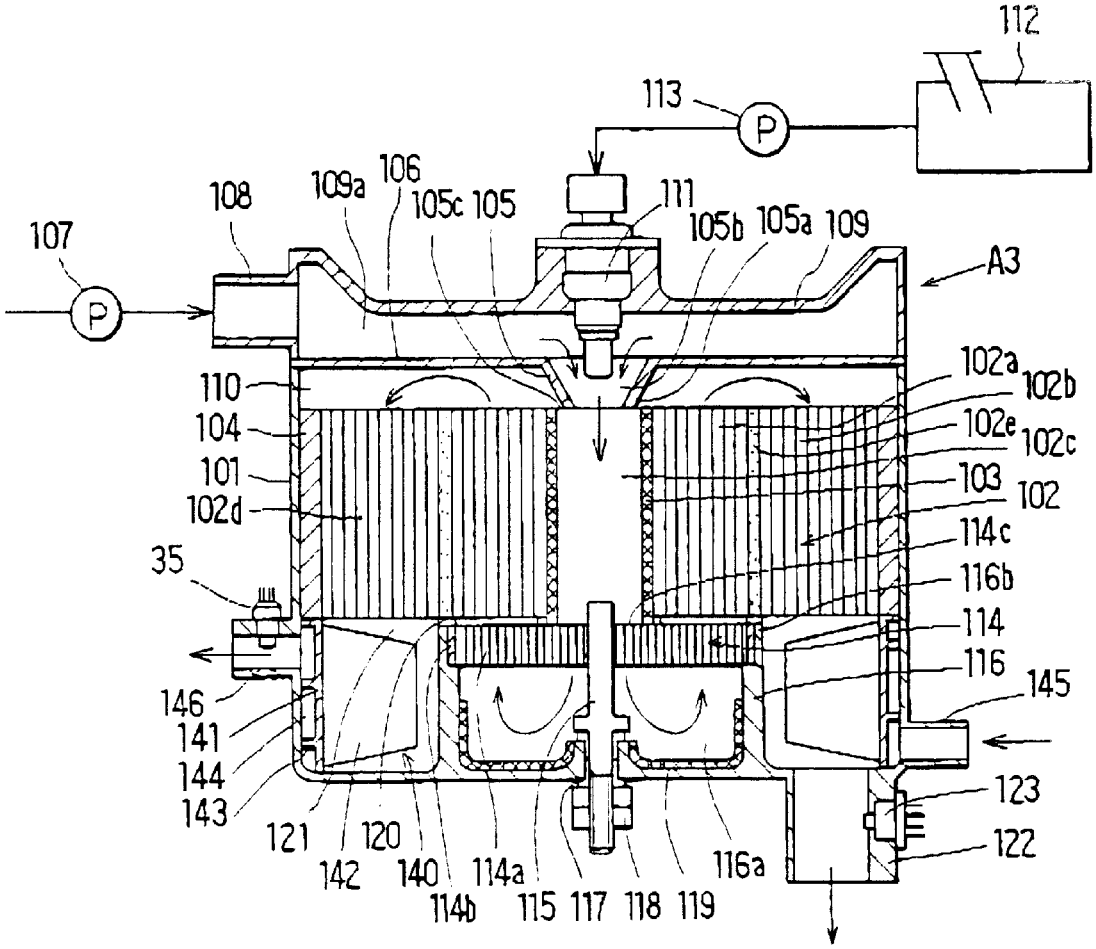
Figure 26:
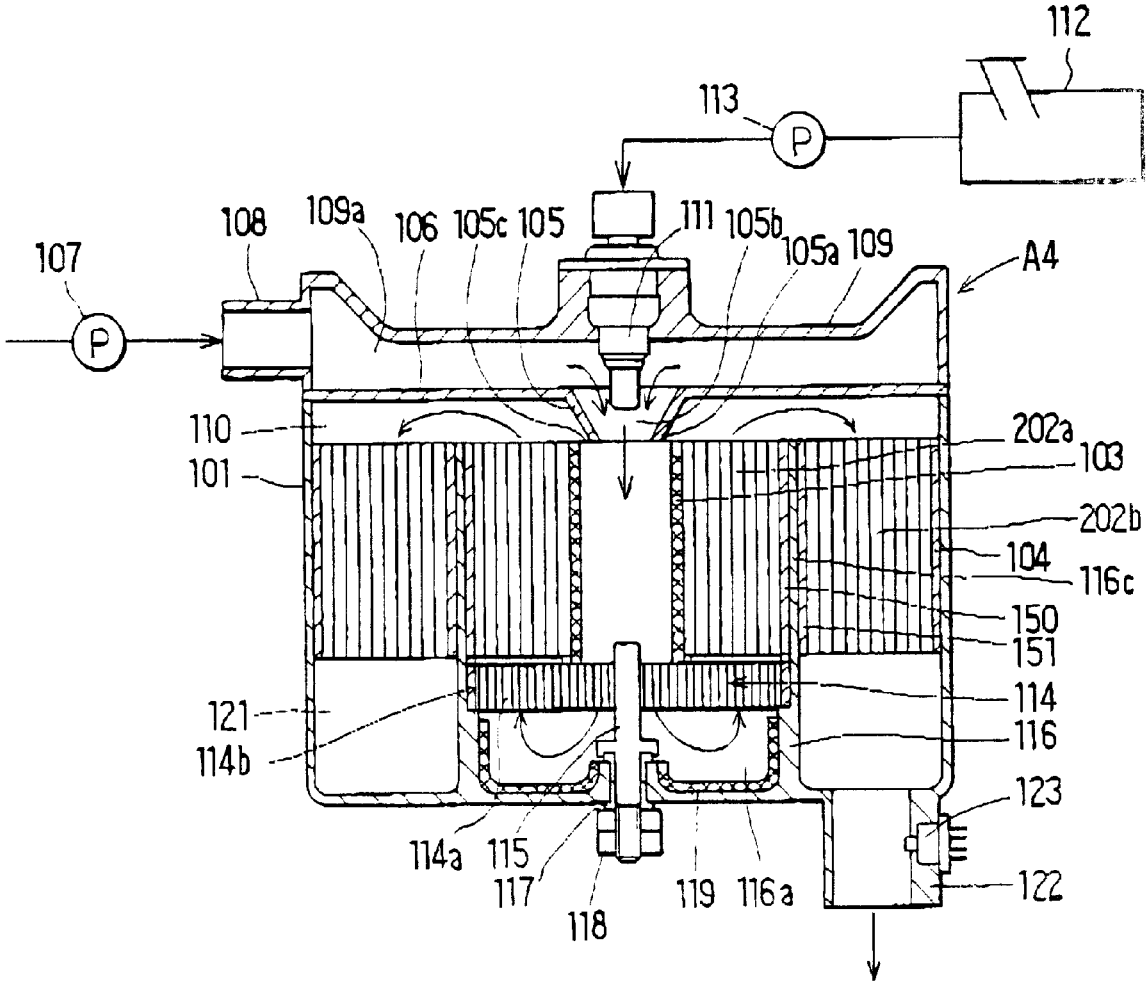
Figure 27:
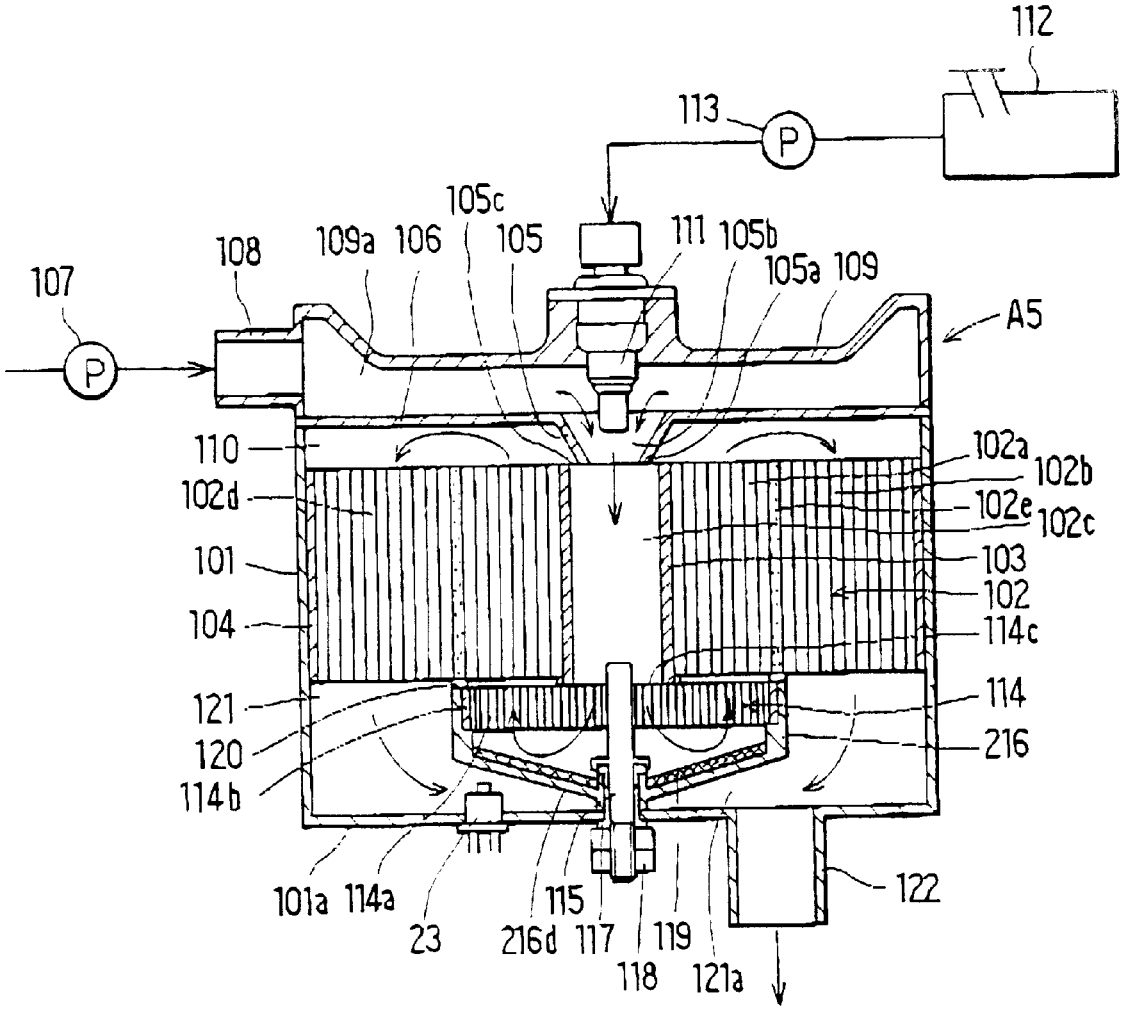
Figure 28:
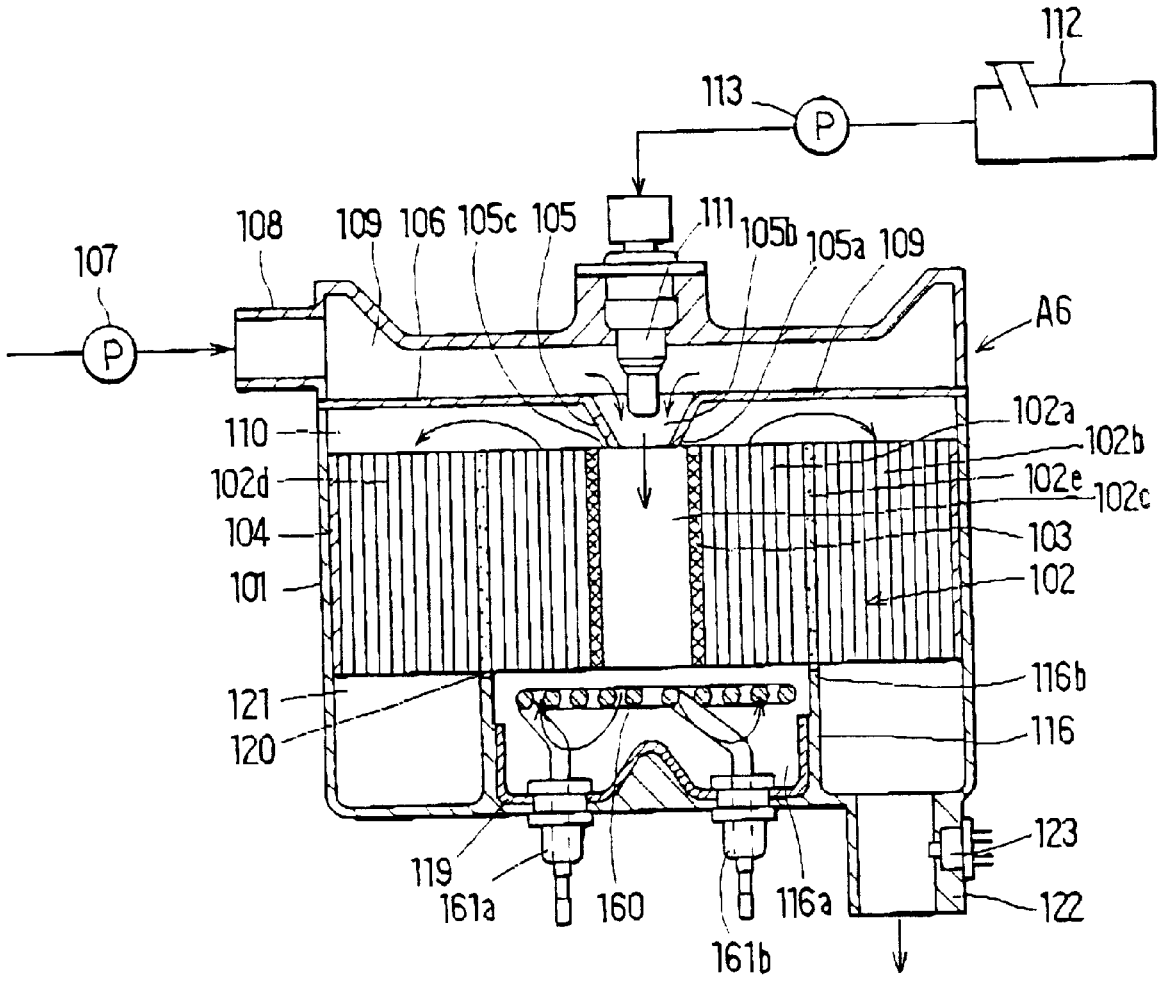

PIG. 22 is a diagram for explaining an operation of the combustion apparatus of the fourteenth embodiment;

FIG. 23 is a longitudinal cross sectional view showing a combustion apparatus in a fifteenth embodiment;

FIG. 24 is a top plan view showing a heat exchanger 130 for the combustion apparatus in the fifteenth embodiment;

FIG. 25 is a longitudinal cross sectional view showing a combustion apparatus in a sixteenth embodiment;

FIG. 26 is a longitudinal cross sectional view showing a combustion apparatus in a seventeenth embodiment;

FIG. 27 is a longitudinal cross sectional view showing a combustion apparatus in an eighteenth embodiment; and FIG. 28 is a longitudinal cross sectional view showing a combustion apparatus in a nineteenth embodiment.

DESCRIPTION OF THE PREFERRED EMBODIMENTS

Embodiments of the present invention will be described with reference to the accompanying drawings.

A first embodiment of the present invention will be described.

Figure 1:
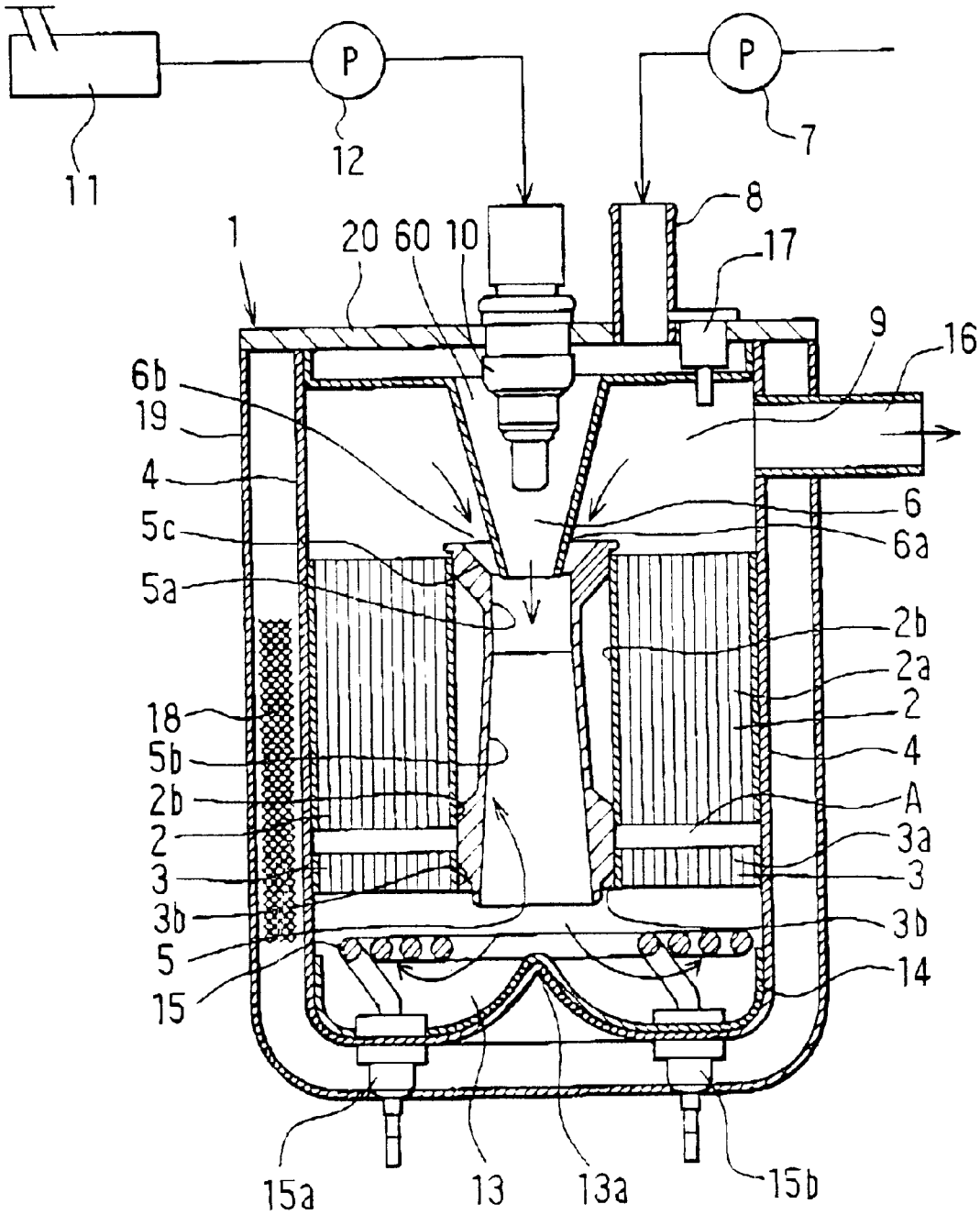
FIG. 1 is a longitudinal cross sectional view showing a first embodiment.

In FIG. 1, a combustion apparatus of this embodiment is employed in a heating system for an electric vehicle, and the up-and-down direction of FIG. 1 is coincident with the vertical direction when the combustion apparatus is mounted on a vehicle. The combustion apparatus 1 is formed into a cylindrical shape having a vertical axis. A main catalyst body 2 is incorporated in the combustion apparatus 1 and formed into a ring (or cylindrical) shape having a bored central portion. A starting catalyst body 3 is disposed adjacent to a lower end face of the main catalyst body 2 to form a small gap A therewith. The starting catalyst 3 is formed, similar to the main catalyst body 2, into a ring shape. Through holes 2*b* and 3*b* are formed at central portions of those rings.

A size of the starting catalyst body 3, i.e., a thermal capacity, is smaller than that of the main catalyst body 2 so that a temperature thereof is more likely to rise. Further, to activate the starting catalyst body 3 at a low temperature (e.g., 200° C.), a carried amount (i.e., the weight ratio of the catalyst to the total weight of catalyst body) of a noble metal catalyst (e.g., Pt or Pd) is larger than that of the main catalyst body 2. On the other hand, the small gap A between the main catalyst body 2 and the starting catalyst body 3 is set to about 5 mm, for example. On the other hand, the catalysts of the main catalyst body 2 and the starting catalyst body 3 are carried by honey-comb carriers 2*a* and 3*a* made of ceramics or the like, respectively. Moreover, the outer circumferences of the main catalyst body 2 and the starting catalyst body 3 are supported with an elastic member (not shown) such as ceramic and metal fiber, and fixed (e.g., press-fitted) in the inner wall surface of a combustion cylinder 4. This combustion cylinder 4 defines a body shape of the combustion apparatus 1 and is formed of a heat-resistant metal such as stainless steel into a cylindrical shape with a bottom. A combustion chamber is defined by the portion in the combustion cylinder 4, which accommodates the catalyst bodies 2 and 3.

An exhaust mixing cylinder 5 is made of a heat-resistant metal such as stainless steel and an entire shape thereof is formed is generally cylindrical. The exhaust mixing cylinder 5 is placed with an elastic member (not shown) such as ceramic and metal fiber in the central through holes 2*b* and 3*b* of the main catalyst body 2 and the starting catalyst body 3, is fixed (press-fitted) to be integrally joined to inner circumferences of the two catalyst bodies 2 and 3. The exhaust mixing cylinder 5 is provided at an one end side thereof (at an entrance side of the burning air and the fuel) with a mixing portion 5*a* composed of a round pipe portion having an equal sectional area and at the other end with a pressure rising portion 5*b* composed of a round pipe having a gentle widening angle (e.g., about 5 to 10 degrees). At the end portion of the entrance side of the mixing portion 5*a*, there is also provided a tapered widening end portion 5*c*.

A primary nozzle 6 is disposed in the combustion cylinder 4 and adjacent to one end side of the main catalyst body 2. This primary nozzle 6 is made of a heat-resistant metal and provided at a lower end side with a funnel-shaped throttle portion 6*a*. The air for combustion and the fuel are introduced from the lower end portion of the primary nozzle 6 into the exhaust mixing cylinder 5. Here, the air for combustion is supplied by an air pump 7 from an air inlet 8 to an internal space 60 of the primary nozzle 6.

On the other hand, the throttle portion 6*a* of the primary nozzle 6 is inserted by a predetermined length into the tapered widening end portion 5*c* of the exhaust mixing cylinder 5. Between the tapered widening end portion 5*c* and the throttle portion 6*a,* there is formed a ring-shaped secondary nozzle 6*b*. This secondary nozzle 6*b* is provided to circulate the exhaust circulation gas from an exhaust gas chamber 9 formed around an outer circumference of the primary nozzle 6, into the exhaust mixing cylinder 5.

The internal space 60 of the primary nozzle 6 is partitioned from the exhaust gas chamber 9 at portions other than the small-diameter opening at a top end of the throttle portion 6*a*. In other words, the primary nozzle 6 is for partitioning an internal space (the space at the fuel/air supply side) 60 and the exhaust gas chamber 9.

A fuel nozzle 10 is for spraying liquid fuel (e.g., kerosene) supplied from a fuel tank 11 by a fuel pump 12, to the central portion of the internal space 60 of the primary nozzle 6. That is, the air inlet 8 from the air pump 7 and the fuel nozzle 10 are opened in the internal space 60 of the primary nozzle 6. In this embodiment, the fuel nozzle 10 and the fuel pump 12 constitute fuel supply means.

A premixing chamber 13 is for mixing the liquid fuel and the burning air. This premixing chamber 13 is disposed in the combustion cylinder 4 and at the other side (at the lower end side) of the main catalyst body 2 and the starting catalyst body 3. A fuel absorber 14 (or wick) is made of a heat-resistant metal and disposed over a wide area from the bottom wall inner face to the side faces of the premixing chamber 13. The fuel absorber 14 can be exemplified not only by the wire-mesh member but also by a foamed metallic member or a porous ceramic member having a thin plate shape.

In the premixing chamber 13, the bottom wall portion opposed to the lower side of the starting catalyst body 3 protrudes in a shape of a mountain at a central portion thereof so that the mixture of the fuel and the air may flow smoothly and turns radially outwardly from the central portion. The protruding portion is shown by numeral 13*a*.

An electric heater 15 is disposed in the premixing chamber 13 and is structured by winding a sheathed heater spirally to heat the starting catalyst body 3 and the fuel absorber 14 at starting. Connection terminals 15*a* and 15*b* are for connecting the electric heater 15 to an external circuit.

An exhaust gas outlet 16 is for discharging the exhaust gas from the exhaust gas chamber 9 to the outside. A temperature detector (thermistor) 17 which is disposed in the exhaust gas chamber 9 and in the vicinity of the exhaust gas outlet 16. An insulator 18 is disposed all over around the combustion cylinder 4, and a cover 19 is disposed therebetween. An upper end plate 20 is for sealing upper end openings of the combustion cylinder 4 and the cover 19, and the fuel nozzle 10 and the air inlet 8 are installed to the upper end plate 20.

The exhaust gas, having been discharged from the exhaust gas outlet 16, is sent to the heat exchanger (not shown), in which a heat exchange is performed between the exhaust gas and the water (heating medium) to heat the water. The heated hot water is pumped to the heater core of an air conditioner so that the air is heated by the heater core to heat a passenger compartment of the vehicle.

Figure 2:
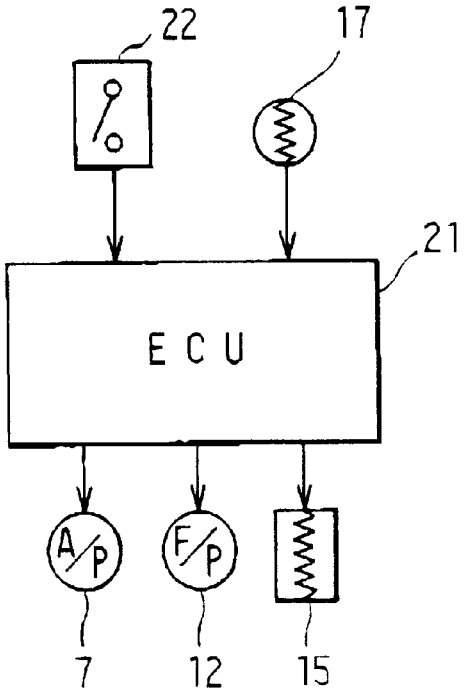
FIG. 2 is a block diagram showing an electric control in the first embodiment of the present invention.

FIG. 2 is a block diagram showing an electric control of the first embodiment. A control unit 21 is for controlling the aforementioned electric devices 7, 12 and 15 in the combustion apparatus, and numeral 22 denotes an operation switch of the combustion apparatus 1.

Figure 3:
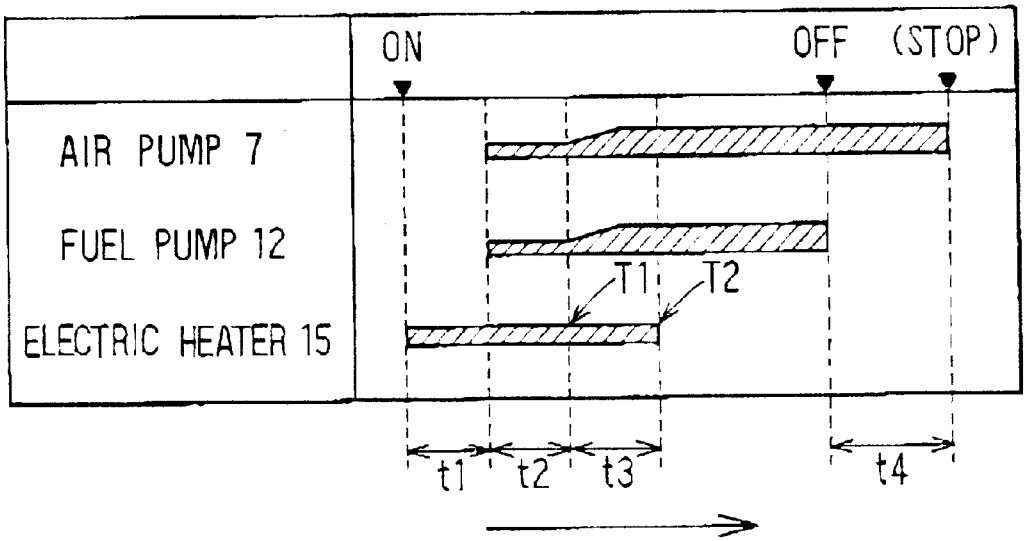
FIG. 3 is a diagram for explaining an operation of the first embodiment of the present invention.

An operation of the above-described construction will be described. When the operation switch 22 is turned ON, firstly, the electric heater 15 is electrified so that the starting catalyst body 3 and the fuel absorber 14 are preheated by the heat of the electric heater 15. When a predetermined time period t1 (as indicated in FIG. 3) has elapsed after the switch ON of the operation switch 22, the air pump 7 and the fuel pump 12 are electrified by the timer in the control unit 21 so that the supply of the air for combustion and the fuel are started.

Firstly, amounts of the air for combustion and the fuel to be supplied are suppressed (e.g., approximately one tenth of that in the maximum combustion amount) by lowering the rotational speed of the two pumps 7 and 12 with the control unit 21. When a large amount of air for combustion flows from the beginning, the starting catalyst body 3 and the fuel absorber 14 are cooled, and there may be no occurrence of the catalytic reaction.

The liquid fuel is sprayed from the fuel nozzle 10 to the central portion of the internal space 60 of the primary nozzle 6, whereas the air for combustion is supplied from the air inlet 8 into the internal space 60 of the primary nozzle 6. The liquid fuel sprayed from the nozzle 10 is injected downward in the exhaust mixing cylinder 5 and is evaporated on the fuel absorber 14 in the premixing chamber 13 so that the fuel is mixed with the air for combustion. The mixture is turned in the direction (that is, makes a U-turn) in the premixing chamber 13 to flow upward into the starting catalyst body 3 and reacts to be burnt in the starting catalyst body 3.

The main catalyst body 2 is gradually heated by the radiation and the high-temperature reaction gas from the starting catalyst body 3. Moreover, when a predetermined time period t2, as indicated in FIG. 3, has elapsed since the supply of the fuel and the air is started or when the detected temperature of the temperature detector 17 disposed in the exhaust gas chamber 9 reaches a predetermined value $T_1$ (e.g., about 300° C. in case of the kerosene fuel), the rotational speed of the two pumps 7 and 12 are gradually increased by the control unit 21 so that the combustion amount is increased. The combustion gas, which is ascending in the starting catalyst body 3 and the main catalyst body 2, flows into the exhaust gas chamber 9 and is discharged from the exhaust gas outlet 16 to the outside.

When the detected temperature of the temperature detector 17 reaches a second predetermined level $T_2$ (e.g., about 500° C. in case of the kerosene fuel), it is then determined that the main catalyst body 2 has been activated, so that the electric power supply to the electric heater 15 is stopped by the control unit 21. From now on, the combustion shifts to a steady operation mode. In place of the determination of the detected temperature of the temperature detector 17> the predetermined temperature T2, a predetermined time period t3, as indicated in FIG. 3, may be set by a timer so that the electric power supply to the electric heater 15 may be stopped in response to the lapse of the predetermined time period t3.

In the above-described steady combustion, the air for combustion is accelerated and injected from the throttle portion 6*a* of the primary nozzle 6 into the mixing portion 5*a* having an equal cross sectional area, of the exhaust mixing cylinder 5. By the ejector effect of the accelerated combustion air flow, the vicinity of the secondary nozzle 6*b* is decompressed to circulate a part of the exhaust gas in the exhaust gas chamber 9 into the exhaust mixing cylinder 5 through the secondary nozzle 6*b*. Here, the exhaust mixing cylinder 5 is equipped at a downstream side of the mixing portion 5*a* with the pressure rising portion 5*b* made of a round pipe having a gently widening angle, so that the mixture of the air for combustion and the fuel restores pressure while passing through the pressure rising portion 5*b*, by converting a velocity component into pressure.

In the combustion apparatus of this embodiment, as described above, by recirculating a part of the exhaust gas of the exhaust gas chamber into the air for combustion, such air for combustion can be preheated by the high-temperature exhaust gas heat to maintain the catalyzers 2 and 3 activated so that the catalyst combustion can be satisfactorily continued. Moreover, the primary nozzle 6 to be supplied with the air for combustion is disposed at the central portion of the exhaust gas chamber 9 so that the air for combustion and the exhaust gas flow as counterflows inside and outside of the primary nozzle 6. Therefore, by the heat conduction through the primary nozzle (partitioning member) 6 made of a metal, the air for combustion can be preheated by the exhaust gas so that the preheating effect is further improved.

At the stop of combustion, the operation switch 22 is turned OFF. In response to the OFF operation, the control unit 21 instantly stops the fuel pump 12 but allows the air pump 7 to operate for a predetermined time period t4 so that the residual fuel in the combustion cylinder 4 is burned out and the combustion cylinder 4 is cooled (the post-purge operation). After lapse of the predetermined time period t4, all components are stopped by stopping the air pump 7.

According to the first embodiment as described above, since the fuel is supplied or stopped while the catalyst bodies 2 and 3 are activated, emission is hardly discharged even at the time of ignition or extinction so that a clean combustion can be achieved. At the starting time, the fuel and the catalyst are efficiently preheated by the single electric heater 15 which is disposed in the premixing chamber 13. During the steady combustion, the recirculation of the exhaust gas is utilized for preheating the air for combustion so that a highly efficient combustion can be achieved without using an electric heater and with economy electric power.

Figure 4:
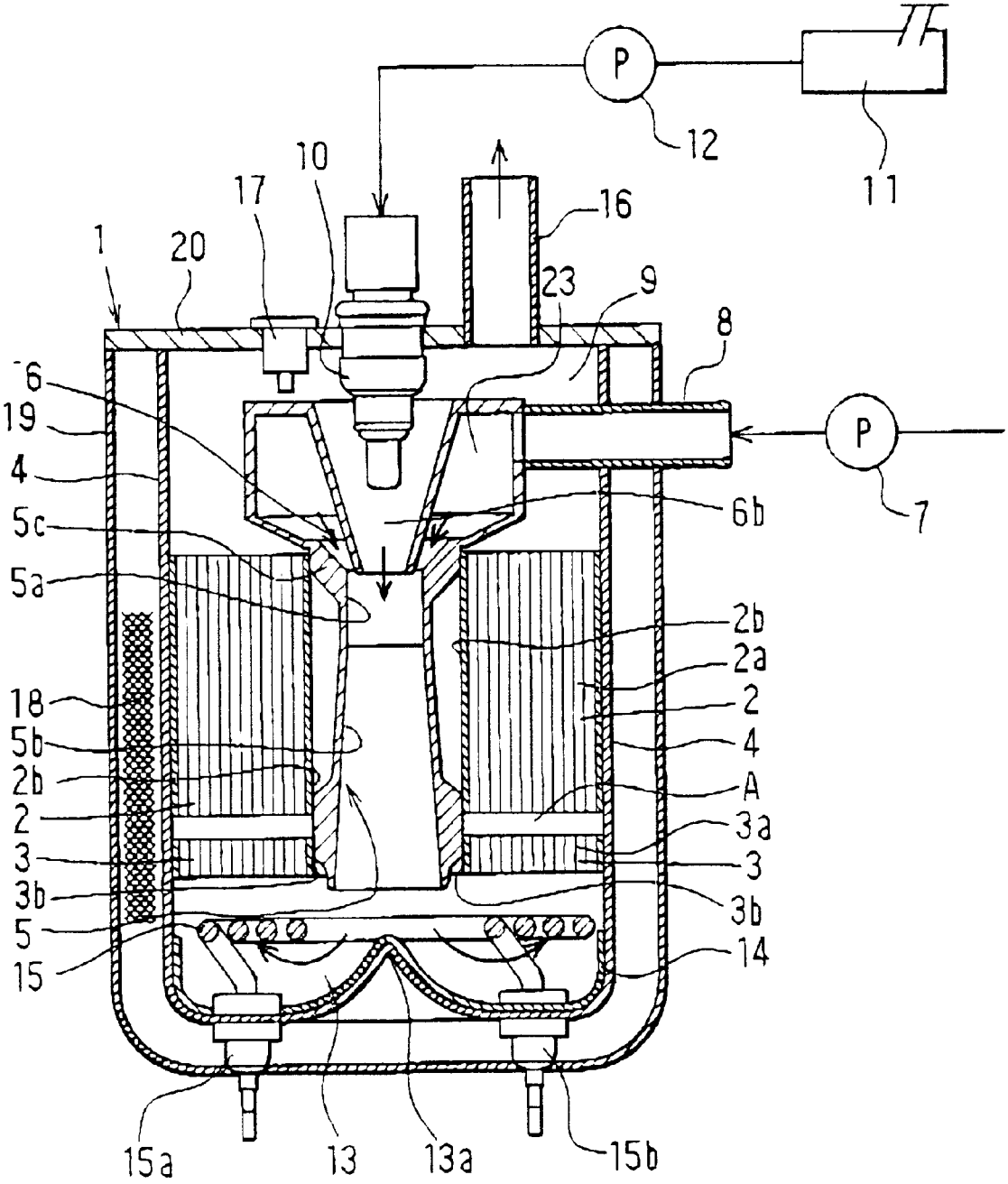
FIG. 4 is a longitudinal cross sectional view showing a second embodiment of the present invention.

A second embodiment of the present invention will be described with reference FIG. 4.

In the first embodiment, at one end side of the catalyst bodies 2 and 3, the primary nozzle 6 for injecting the air for combustion is disposed at the central portion of the combustion cylinder 4, and the secondary nozzle 6*b* for circulating the exhaust gas by the ejector effect is formed around the primary nozzle 6. In the second embodiment, on the contrary, the primary nozzle 6 and the secondary nozzle 6*b* are disposed in the reversed positions, that is, the secondary nozzle 6*b* is disposed at the central side whereas the primary nozzle 6 is disposed in a ring shape around the secondary nozzle 6*b*.

In the second embodiment, more specifically, there is formed an air chamber 23 for combustion, which is partitioned from the exhaust gas chamber 9, and the air chamber 23 is connected to the air inlet 8 so that the air for combustion is introduced thereinto. The introduction air is injected into the exhaust mixing cylinder 5 from the ring-shaped primary nozzle 6.

On the other hand, the secondary nozzle 6*b* is formed at the central portion of the primary nozzle 6, and an inside thereof is supplied with only the liquid fuel, as sprayed from the fuel nozzle 10, but with no air for combustion. The inner space of the secondary nozzle 6*b* is wholly opened to the exhaust gas chamber 9 at an upper portion thereof.

By the ejector effect in which the air for combustion is injected from the primary nozzle 6, the top end portion of the secondary nozzle 6*b* is decompressed so that the exhaust gas in the exhaust gas chamber 9 is partially circulated into the exhaust mixing cylinder 5 through the secondary nozzle 6*b*.

According to the construction of the second embodiment, the air for combustion, supplied from the air inlet 8, can be preheated in a wide heat exchanging (heat conducting) area, before entering the exhaust mixing cylinder 5, by the exhaust gas flowing around the inner and outer circumferences of the air for combustion chamber 23. As a result, the air for combustion can be efficiently preheated. The other effects similar to those of the first embodiment can be also obtained.

Figure 5:
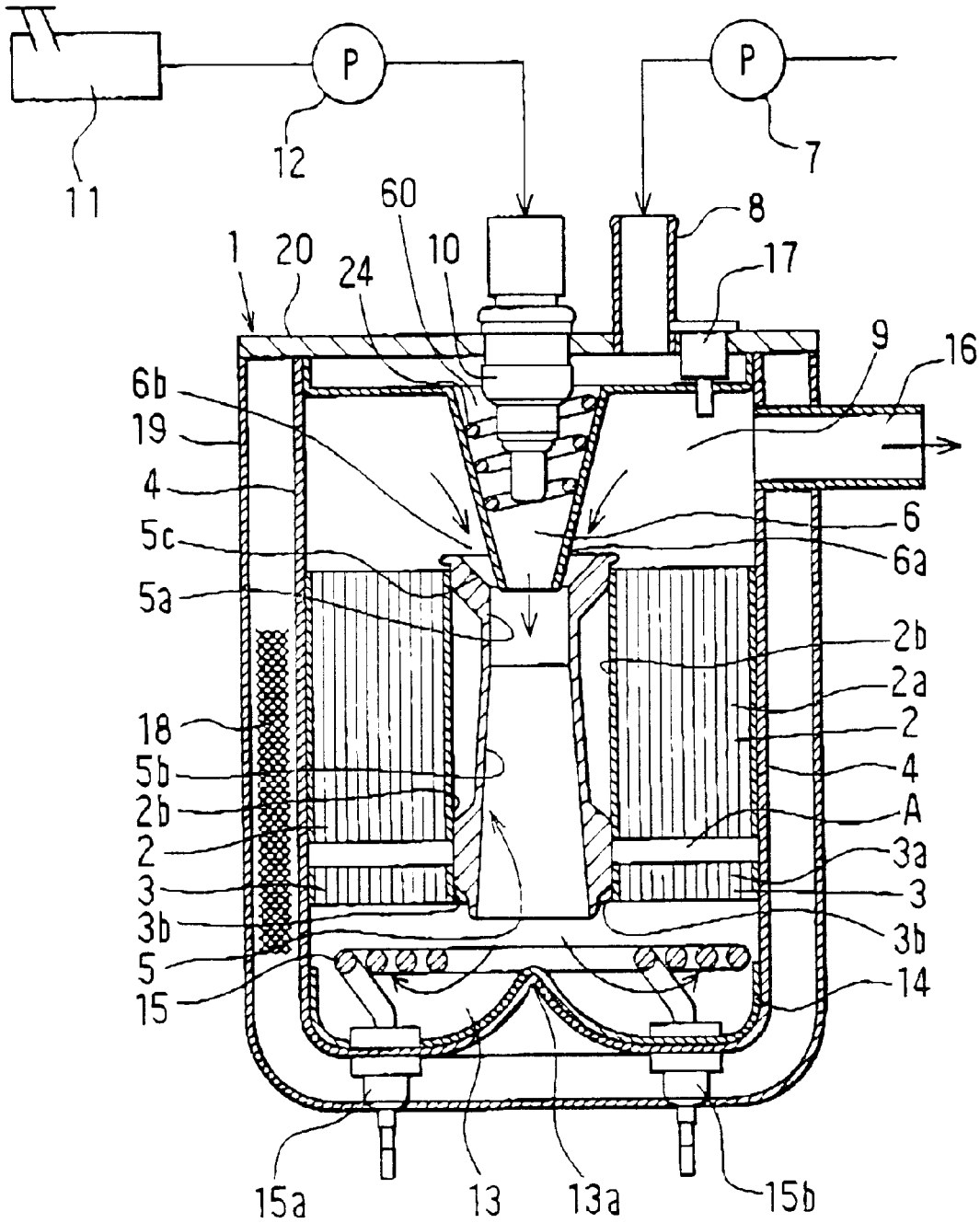
FIG. 5 is a longitudinal cross sectional view showing a third embodiment of the present invention.

A third embodiment of the present invention will be described With reference to FIG. 5.

An object of the third embodiment is to improve the starting performance of the combustion at a low temperature in the first embodiment. Therefore, in the third embodiment, an auxiliary electric heater 24 made of a PTC heater is spirally disposed in the internal space 60 of the primary nozzle 6, as shown in FIG. 5. As a result, at a cold start in extremely cold districts, the auxiliary electric heater 24 is also electrified simultaneously with the electric heater 15 so that the effect of preheating the air for combustion can be improved to stabilize the combustion.

Figure 6:
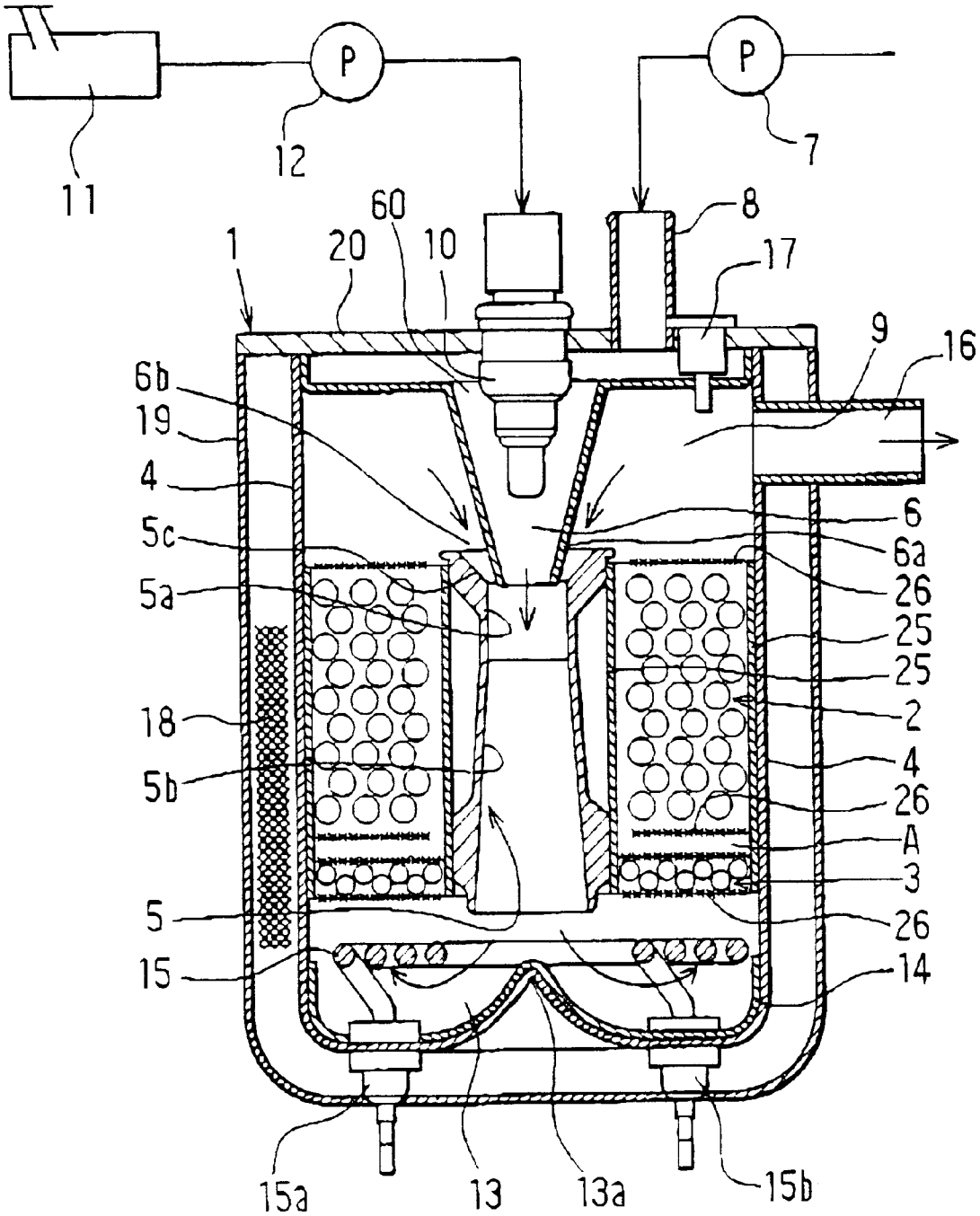
FIG. 6 is a longitudinal cross sectional view showing a fourth embodiment of the present invention.

A fourth embodiment of the present invention will be described with reference to FIG. 6.

In any of the aforementioned first to third embodiments, the catalysts of the catalyst bodies 2 and 3 are carried in the honey-comb shaped carriers 2*a* and 3*a*. In the fourth embodiment, on the contrary, the numerous granular catalyst bodies 2 and 3 are disposed in a hollow double-structured cylindrical body 25 such these catalyst bodies 2 and 3 are held in the double-structured cylindrical body 25 by a support member 26 made of wire mesh. With this construction, the present invention can be embodied.

Figure 7:
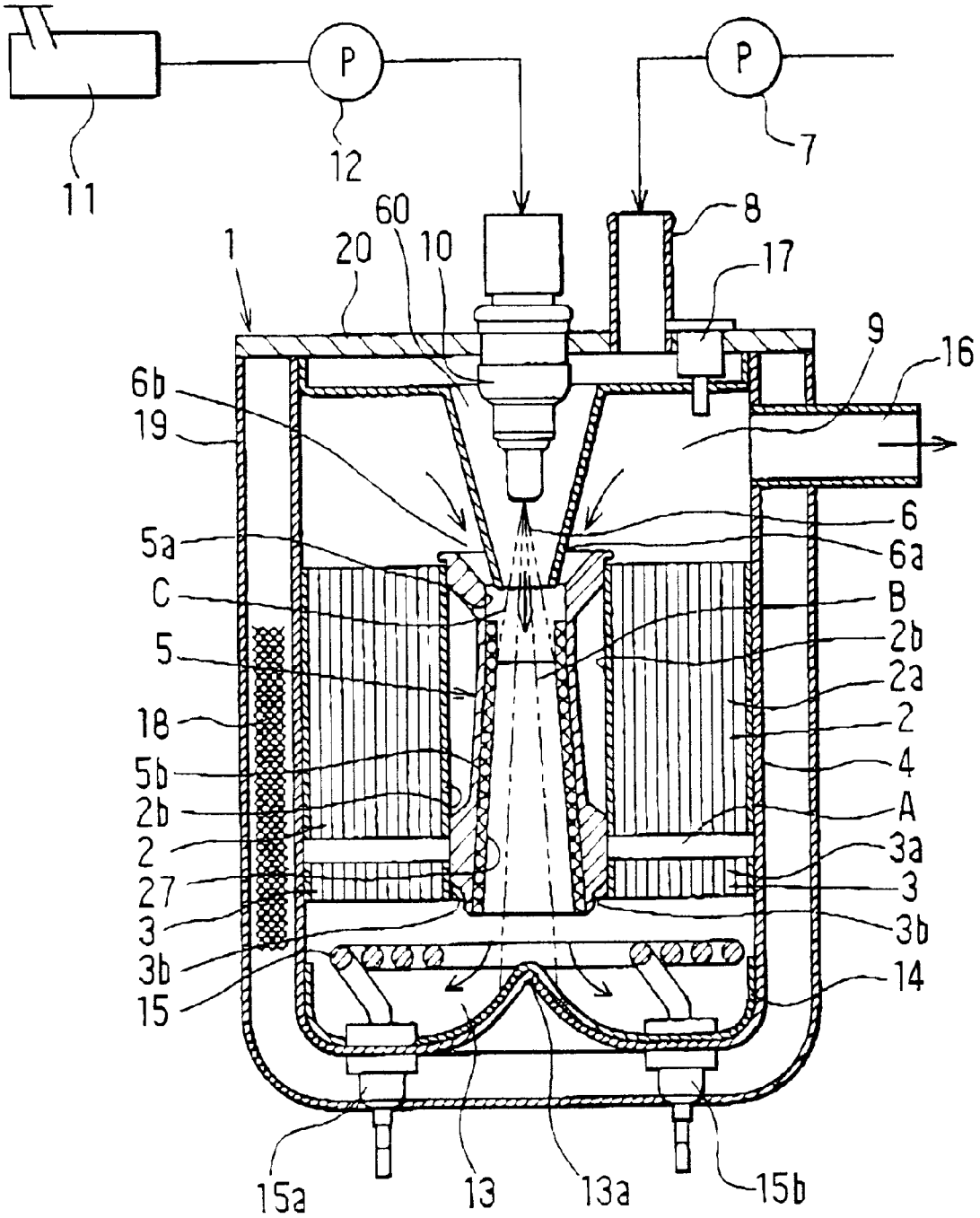
FIG. 7 is a longitudinal cross sectional view showing a fifth embodiment of the present invention.
Figure 8A:
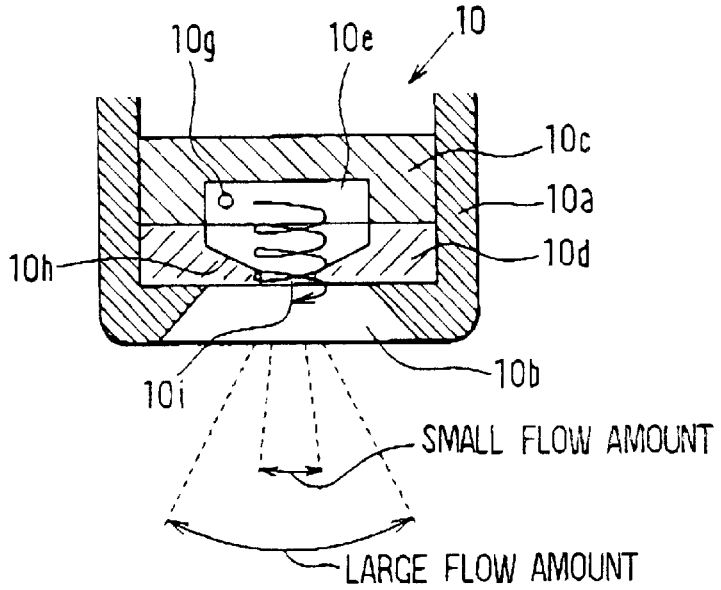
FIG. 8A is an cross sectional view showing an essential portion of a fuel nozzle in the fifth embodiment.

A fifth embodiment of the present invention will be described with reference to FIGS. 7 to 9.

In any of the foregoing first to fourth embodiments, the liquid fuel is sprayed from the fuel nozzle 10 toward the fuel absorber 14 in the premixing chamber 13 so that fuel is wholly evaporated in the fuel absorber 14. When the combustion shifts to the steady state to increase the combustion amount (fuel flow amount), the evaporation capacity may be insufficient for the whole fuel to be evaporated by the fuel absorber 14, and the fuel evaporation may deteriorate.

In view of this problem, an object of the fifth embodiment is to improve the evaporation performance of the liquid fuel even at the maximum combustion amount by effectively employing the heat of the high-temperature portion in the combustion apparatus. Specifically, in the fifth embodiment, as shown in FIG. 8, a swirl type fuel nozzle is employed as the fuel nozzle 10. The swirl type fuel nozzle 10 has a pipe-shaped housing 10*a* made of a heat-resistant metal such as stainless steel. A spray hole 10*b* having a widening shape is opened at a top end portion.

In the top end portion of the housing 10*a,* there are disposed first and second plate-shaped members 10*c* and 10*d* laminated from the upstream side to the downstream side of the fuel flow and fixed on the inner wall face of the housing 10*a*. A circular swirl chamber 10*e* is formed between the two plate-shaped members 10*c* and 10*d*.

Figure 8B:
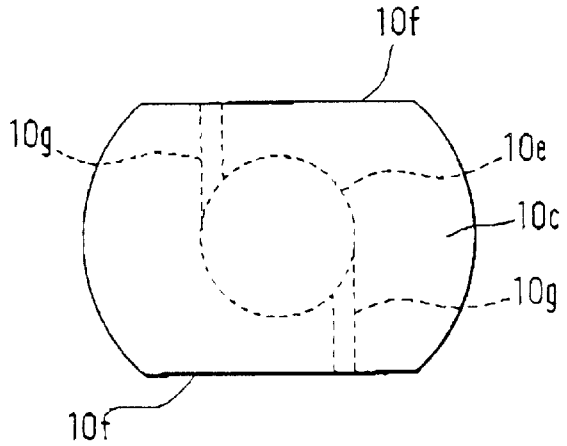
FIG. 8B is a top plan view showing a first plate member of the fuel nozzle.
Figure 9:
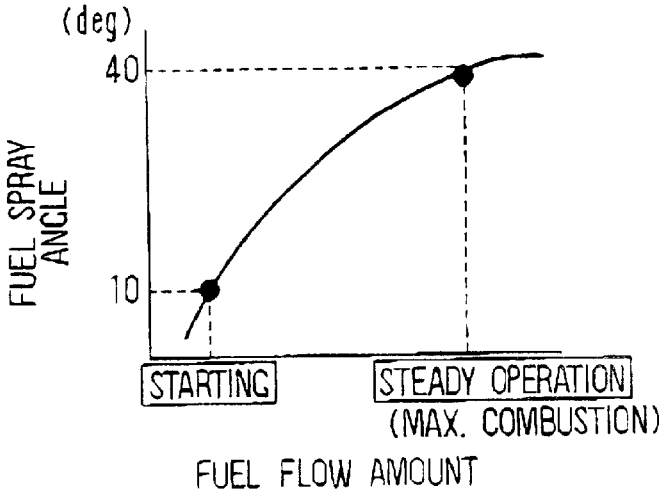
FIG. 9 is a diagram illustrating the operation characteristics of the fuel nozzle shown in FIG. 8.

The first plate-shaped member 10*c* located at the upstream side is formed in a planar shape having two parallel flat side face portions 10*f,* as shown in FIG. 8B, to form a space, into which the fuel flows, between the flat side face portions 10*f* and the inner wall face of the housing 10*a*. In the first plate-shaped member 10*c,* there are further formed two fuel introducing holes 10*g* at symmetric positions of 180 degrees, for communicating between the flat side face portions 10*f* and the circular swirl chamber 10*e*.

These fuel introducing holes 10*g* are tangentially opened in the circular swirl chamber 10*e* so that the fuel from the flat side face portions 10*f* may be tangentially introduced into the circular swirl chamber 10*e* to form a swirling flow.

On the other hand, the second plate-shaped member 10*d* has a tapered surface 10*h* reducing the cross sectional area of the circular swirl chamber 10*e* gradually. A throttle hole 10*i* is formed in the top end portion of the tapered surface 10*h*. The two plate-shaped members 10*c* and 10*d* described above are preferably made of brass which is machined readily.

In the swirl type fuel nozzle 10 as constructed above, the swirling force of the fuel in the circular swirl chamber 10*e* depends upon the fuel flow amount so that the fuel nozzle 10 has characteristics in which the fuel spray angle increases with the fuel flow amount.

Throughout the whole length of the pressure rising portion 5*b* from midway of the mixing portion 5*a* of the exhaust mixing cylinder 5, a fuel absorber 27 is disposed in and joined to the inner circumference of the exhaust mixing cylinder 5.

The fuel absorber 27 can be made of a wire-mesh member of a heat-resistant metal, similar to the fuel absorber 14 in the premixing chamber 13.

According to the fifth embodiment, when the combustion amount (fuel flow amount) is low as at the combustion starting time, the swirling force of the fuel is low in the swirl type fuel nozzle 10 so that the fuel spray angle becomes a value as small as about 10 degrees. As a result, the fuel sprayed from the fuel nozzle 10 passes through the inside of the exhaust mixing cylinder 5, without being absorbed by the fuel absorber 27 of the exhaust mixing chamber 5, as indicated by double-dotted lines in FIG. 7, and reaches the fuel absorber 14 in the premixing chamber 13 so that the fuel is evaporated in the fuel absorber 14 by the heat from the electric heater 15.

Since the fuel flow amount is low at this time, the fuel can be satisfactorily evaporated only by the fuel absorber 14.

When the combustion shifts to the steady operation to increase the combustion amount (fuel flow amount), the swirling force of the duel increases in the swirl type fuel nozzle 10 so that the fuel spray angle increases to be as high as about 40 degrees at the maximum combustion.

Since the fuel spray angle of the fuel nozzle 10 increases, a part of the fuel, sprayed from the fuel nozzle 10, comes into contact (as indicated by single-dotted lines C in FIG. 7) with and is absorbed by the fuel absorber 27 in the exhaust mixing cylinder 5. The fuel absorber 27 is heated by the heat transferred from the high-temperature catalyst bodies 2 and 3 through the metallic wall surface of the exhaust mixing cylinder 5 so that the fuel is satisfactorily evaporated in the fuel absorber 27.

As compared with the first to fourth embodiments in which the fuel is absorbed only by the fuel absorber 14 in the premixing chamber 13, according to the fifth embodiment, the sprayed fuel can be dispersed into both the fuel absorber 14 and the fuel absorber 27. At the same time, the fuel absorber 27 can be heated to a high temperature by the heat transferred from the catalyst bodies 2 and 3 so that the fuel can be satisfactorily evaporated even at the maximum combustion. As a result, the combustion state can be maintained satisfactorily from the starting time to the maximum combustion time.

Figure 10A:
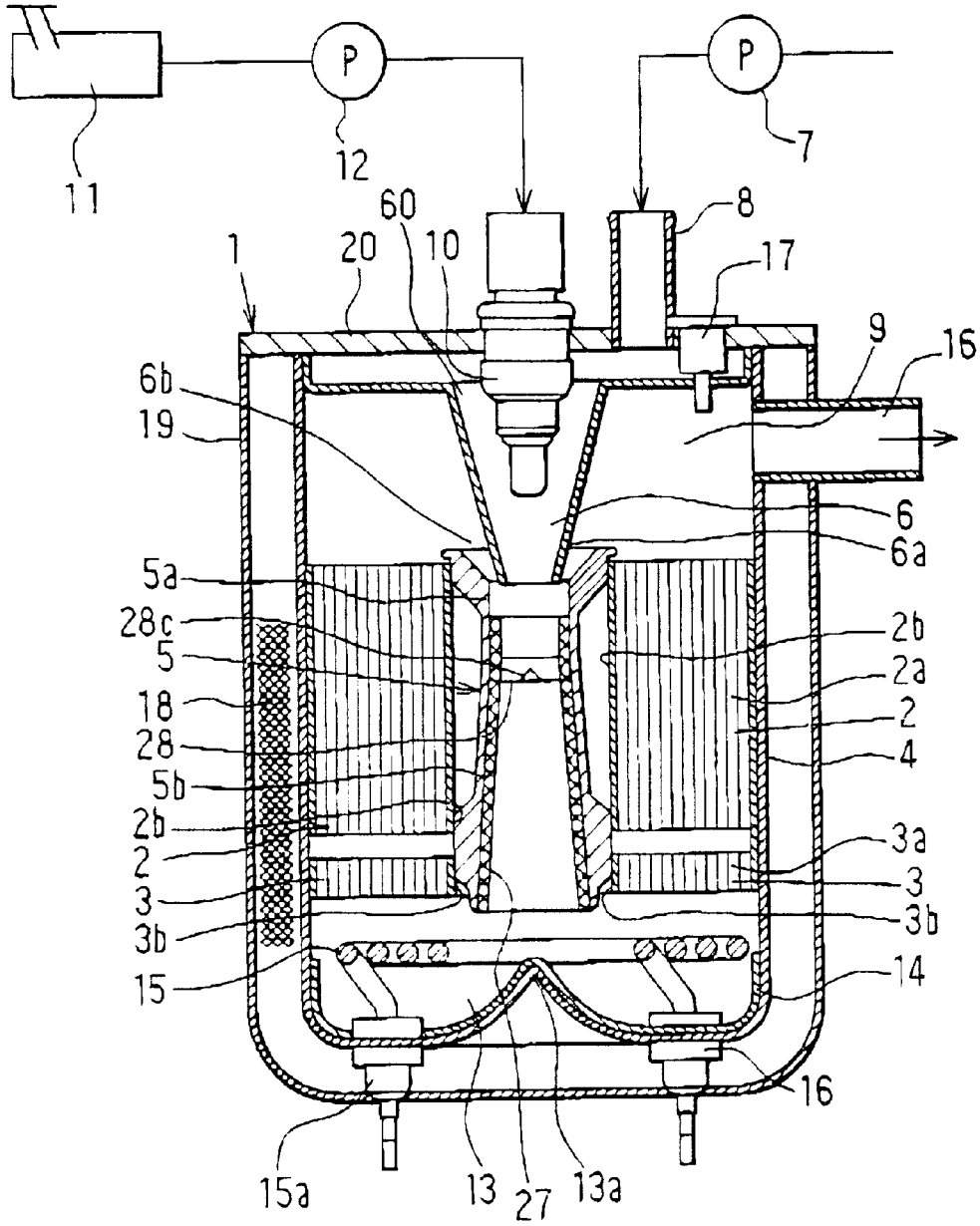
FIG. 10A is a longitudinal cross sectional view showing a sixth-embodiment of the present invention.

A sixth embodiment of the present invention will be described With reference to FIG. 10A.

The sixth embodiment is a modification of the aforementioned fifth embodiment. Specifically, the fifth embodiment employs the swirl type fuel nozzle 10 having the characteristics in which the fuel spray angle increases with the fuel flow amount. In the sixth embodiment, on the other hand, the swirl type fuel nozzle 10 is replaced by the fuel nozzle 10 similar to those of the foregoing first to fourth embodiments. Specifically, the fuel nozzle 10 is of the type in which the nozzle is opened to spray the fuel when the pressure of fuel supplied from the fuel pump 9 exceeds a predetermined value. In the fuel nozzle 10 of this type, the fuel spray angle is substantially constant irrespective of the increase or decrease in the fuel flow amount.

In the sixth embodiment, therefore, the fuel absorber 27 is disposed in the exhaust mixing cylinder 5, and a deflecting plate 28 for deflecting the fuel flow is additionally provided.

Figure 10B:
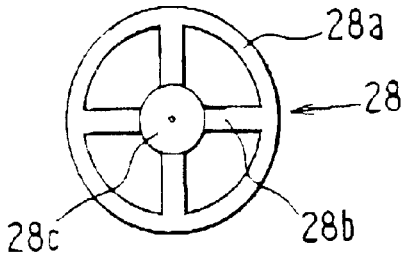
FIG. 10B is a top plan view of a deflecting plate in the sixth embodiment of the present invention.

This deflecting plate 28 is made of a heat-resistant metal such as stainless steel and has a circular ring portion 28*a* having an external diameter substantially equal to the internal diameter of the exhaust mixing cylinder 5, as shown in the top plan view of FIG. 10B. There is provided a plurality of radial arm portions 28*b* inside the circular ring portion 28*a* and a conical portion 28*c* at the central portion of the radial arm portions 28*b*. The top portion of the conical portion 28*c* is disposed to face the upstream side of the fuel flow in the exhaust mixing cylinder 5. In the embodiment shown in FIG. 10A, the deflecting plate 28 is disposed in the exhaust mixing cylinder 5 and in the vicinity of the upstream end of the pressure rising portion 5*b* and is joined to the inner wall surface of the exhaust mixing cylinder 5.

According to the sixth embodiment, the fuel sprayed from the fuel nozzle 10 into the exhaust mixing cylinder 5 comes into contact with the deflecting plate 28. At this time, when the fuel flow amount is low as at the starting time, the fuel spraying speed is so low that most of the fuel, having come into contact with and being adhered to the deflecting plate 28, drops as it is by its gravity. As a result, most of the sprayed fuel from the fuel nozzle 10 reaches the fuel absorber 14 in the premixing chamber 13 so that the fuel is evaporated therein.

When the fuel flow amount is high as at the maximum combustion, the fuel spraying speed is so high that a part of the fuel sprayed from the fuel nozzle 10 collides with and bounces on the deflecting plate 28 Then, the fuel having collided is absorbed by the fuel absorber 27 in the exhaust mixing cylinder 5 and is evaporated therein. When an amount of the fuel flow is large, since the sprayed fuel can be dispersed into both the fuel absorber 14 and the fuel absorber 27 and evaporated therein, the fuel can be satisfactorily evaporated to maintain the satisfactory combustion state even at the maximum combustion.

A seventh embodiment of the present invention will be described with reference to FIG. 11.

Figure 11:
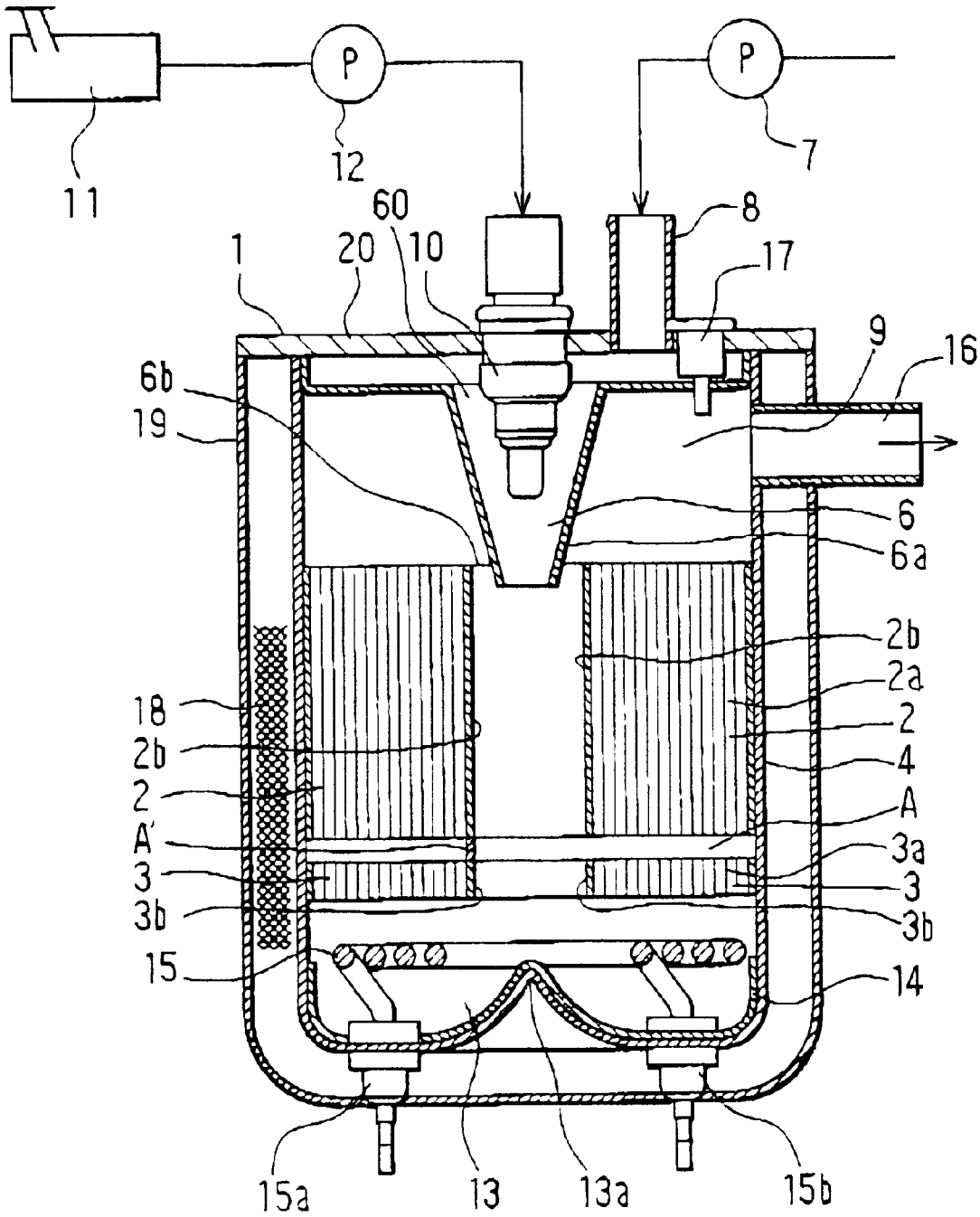
FIG. 11 is a longitudinal cross sectional view showing a seventh embodiment of the present invention.

As shown in FIG. 11, in the seventh embodiment, the exhaust mixing cylinder 5 in the fifth embodiment is not employed, and a cylindrical spacer A is sandwiched between the maon catalyst body 2 and the starting catalyst body 3 (in a miunute gap A) in a direction as to connect each pair of through-holes 2*b* and 3*b*. The exhaust gas is mixed with the air for combustion by the through holes 2*b* and 3*b* of the catalyst bodies 2 and 3.

In this case, the efficiency of recirculating the exhaust gas into the air for combustion may deteriorate, but the structure can be simplified by omitting the exhaust mixing cylinder 5. At the same time, the fuel can be sprayed directly onto the inner wall surfaces of the catalyst bodies 2 and 3 which are heated to a high temperature by the combustion, to improve the evaporation of the fuel. In this case, the fuel absorber 27 is mounted on the inner wall surface of the main catalyst body 2, the fuel can be stably maintained on the inner wall surface of the main catalyst body 2 to further improve the evaporation of the fuel.

Similar to the fifth embodiment, the exhaust mixing cylinder 5 can be omitted even in the first to fourth embodiments and the sixth embodiment.

An eighth embodiment of the present invention will be described.

In the first to seventh embodiments, the electric heater 15 is disposed in the premixing chamber 13, and the starting catalyst body 3 having a small heat capacity is disposed to face the premixing chamber 13 so that the starting performance of the catalyst combustion at a low temperature is improved by preheating the starting catalyst body 3 with the radiation from the electric heater 15. In the eighth embodiment, on the contrary, an electrically conductive starting catalyst body 30 is employed, as shown in FIG. 12, in place of the aforementioned electric heater 15 and starting catalyst body 3.

Figure 12:
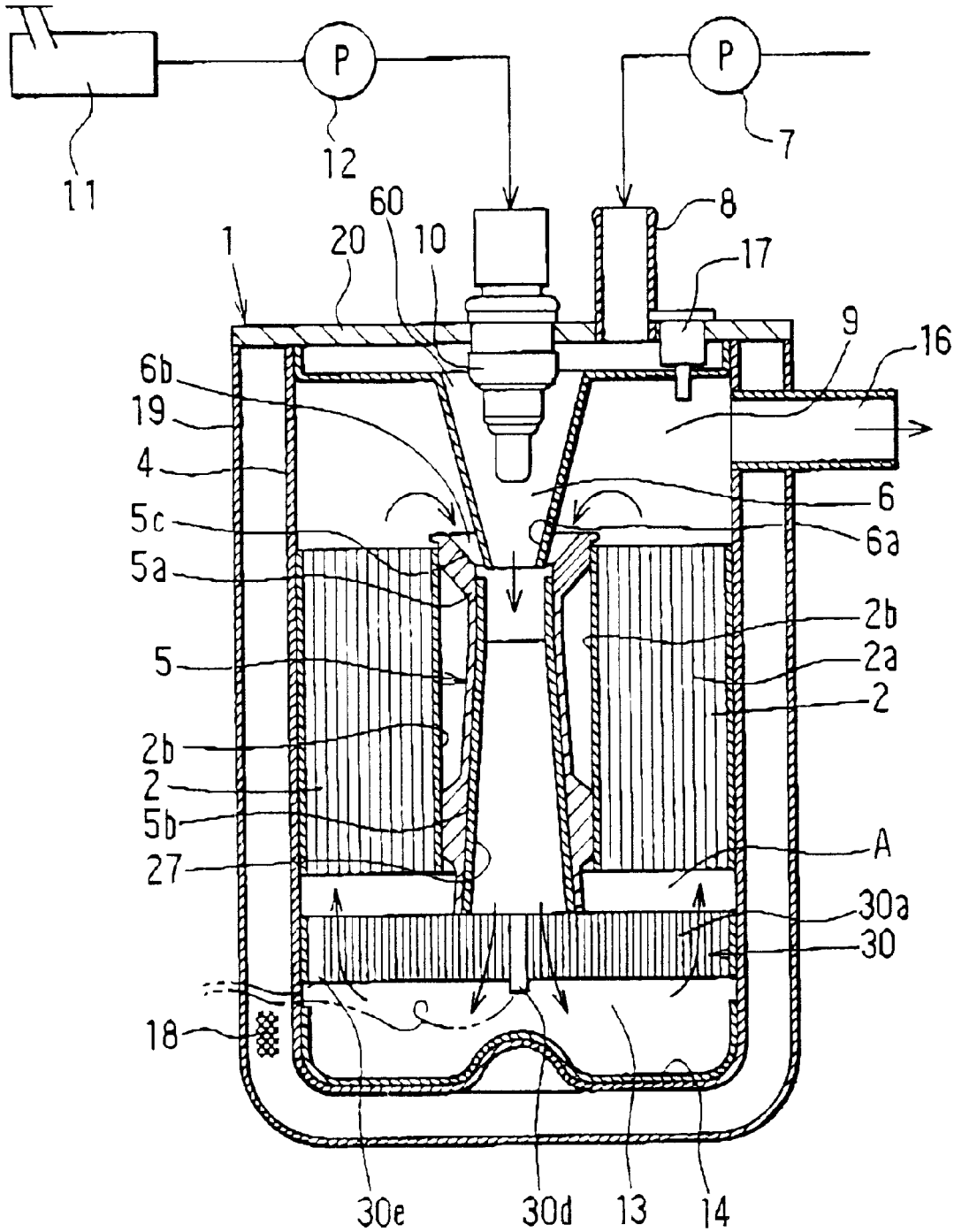
FIG. 12 is a longitudinal cross sectional view showing an eighth embodiment of the present invention.

As shown in FIG. 12, the electrically conductive starting catalyst body 30 is interposed between the main catalyst body 2 and the premixing chamber 13 to form a minute gap A with the main catalyst body 2. The starting catalyst body 30 is structured, as shown in FIG. 13B, such that a carrier 30*a* is formed by laminating flat plates 30*b* and a corrugating plate 30*c*, made of a metallic thin plate of stainless steel (SUS 430 having a thickness of 0.05 mm), a catalyst is carried on the carrier 30*a*, and the carrier 30*a* is wound with many turns, thereby being formed generally into a honeycomb disc shape.

The catalyst to be carried on the carrier 30*a* may be Pt, for example, and a carried amount thereof (i.e., a ratio of the catalyst weight to the total weight of the catalyst body) of about 0.5 wt. %.

Figure 13A:
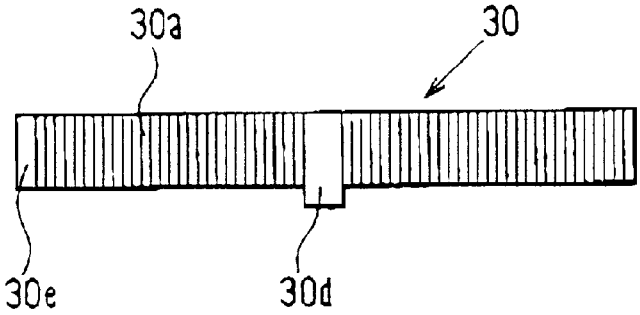
FIG. 13A is a longitudinal cross sectional view showing a starting catalyzer in the eighth embodiment of the present invention.
Figure 13B:
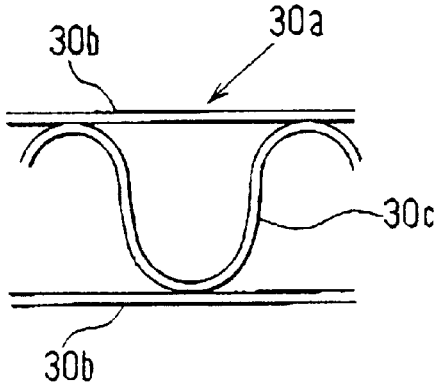
FIG. 13B is an enlarged view showing a portion of the starting catalyzer.

As shown in FIG. 13A, a positive electrode terminal 30*d* is disposed at the central portion of the starting catalyst body 30, and a negative electrode terminal 30*e* is disposed at the outer circumferential portion so that the starting catalyst a body 30 is electrified by applying a voltage between those two electrode terminals 30*d* and 30*e*. In the eighth embodiment, the lower end portions of the exhaust mixing cylinder 5 and the fuel absorber 27 are extended up to abut against an upper face portion of the starting catalyst body 30 so that the mixture of the fuel and the air passing through the exhaust mixing cylinder 5 certainly passes through the starting catalyst body 30.

In the eighth embodiment, the ratio in size between the main catalyst body 2 and the starting catalyst body 3 is 5:1, and the small gap A is set to about 5 mm. The other constructions are the same as those of the first to seventh embodiments.

An operation of the eighth embodiment will be described. When the operation switch 22 shown in FIG. 2 is turned ON, the electric power is supplied from the power source (not shown) to the electrically conductive starting catalyst body 30 through the two electrode terminals 30*d* and 30*e*. The consumed electric power amount of the starting catalyst body 30 is set to about 300 to 400 W, for example. By being electrified, the starting catalyst body 30 functions as an electric heating element by an electric resistance thereof so that the catalyst carried on the carrier 30*a* c be heated directly and promptly.

Simultaneously, the main catalyst body 2 and the fuel absorber 14 can be preheated by the radiation from the starting catalyst body 3.

Figure 14:
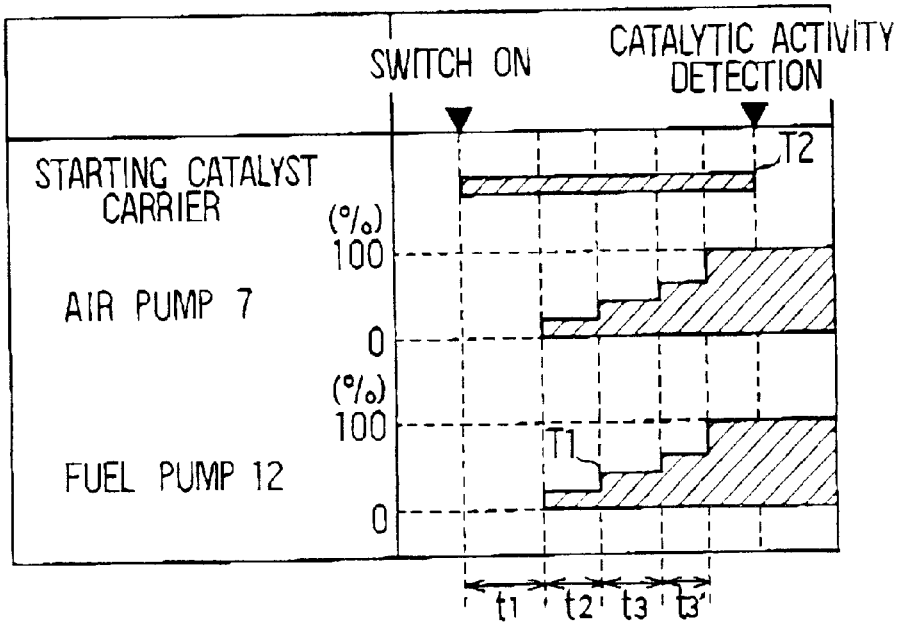
FIG. 14 is a diagram for explaining an operation of the eighth embodiment of the present invention.

When a predetermined time period t1 has elapsed since the operation switch 22 is turned ON as illustrated in FIG. 14, the air pump 7 and the fuel pump 12 are started to supply the air for combustion and the fuel. The supply amount of the air for combustion and the fuel are low at first, and are then stepwise increased as elapsed time periods t2, t3 and t3 sequentially. When the temperature detected by the temperature detector 17 reaches the predetermined level T2, it is determined that the catalyst has become in an activated state, and the electric power supply to the starting catalyst body 30 is interrupted.

According to the eighth embodiment, the metallic catalyst carrier 30*a* of the starting catalyst body 30 functions as the electric heating element by the electric resistance thereof so that the catalyst carried on the carrier 30*a* can be heated directly. As compared with the first to seventh embodiments in which the starting catalyst body 3 is preheated by the radiation from the electric heater 15, the preheating effect of the catalyst can be enhanced, and the consumed electric power can be saved by the improvement in the preheating effect.

With the improvement in the preheating effect of the starting catalyst body 30, the preheating effects of the main catalyst body 2 and the fuel absorber 14 can also be improved. Even at a low temperature, the combustion raising time can be shortened by the combination of the early activation of the catalyst and the promotion of the evaporation of the fuel in the fuel absorber 14.

By omitting the electric heater 15, the whole size of the combustion apparatus can be reduced, and the structure can be simplified to lower the cost.

The catalyst carrier 30*a* of the starting catalyst body 30 may be made of, other than the heat-resistant metal such as stainless steel, the ceramics which are composed mainly of electrically conductive silicon carbide.

Moreover, the starting catalyst body 30 is formed into the disc shape but may be formed into a ring shape having a center hole of an inner diameter equal to that of the main catalyst body 2. In the case of the ring shape, the fuel will pass unlike the case of the disc shape through the center hole of the starting catalyst body 30 and reaches the fuel absorber 14 so that the fuel heating effect by the starting catalyst body 30 is lowered at the combustion starting time to deteriorate the evaporation of the fuel. In place, however, the presence of the center hole of the starting catalyst body 30 can reduce the pressure loss of the mixture of the fuel and the air so that the flow amount of the exhaust gas to be recirculated can be increased. As a result, when the fuel is of a highly evaporatable one such as gasoline, the effect for preheating the air for combustion by the exhaust gas recirculated can be advantageously enhanced to activate the catalyst early.

Even in the eighth embodiment, as shown in FIG. 8, the swirl type fuel nozzle 10 may be employed and the exhaust mixing cylinder 5 may be omitted so that the fuel is directly sprayed at the steady combustion time onto the inner circumferential wall of the main catalyst body 2, which has been heated to a high temperature.

A ninth embodiment of the present invention will be described with reference to FIG. 15.

Figure 15:
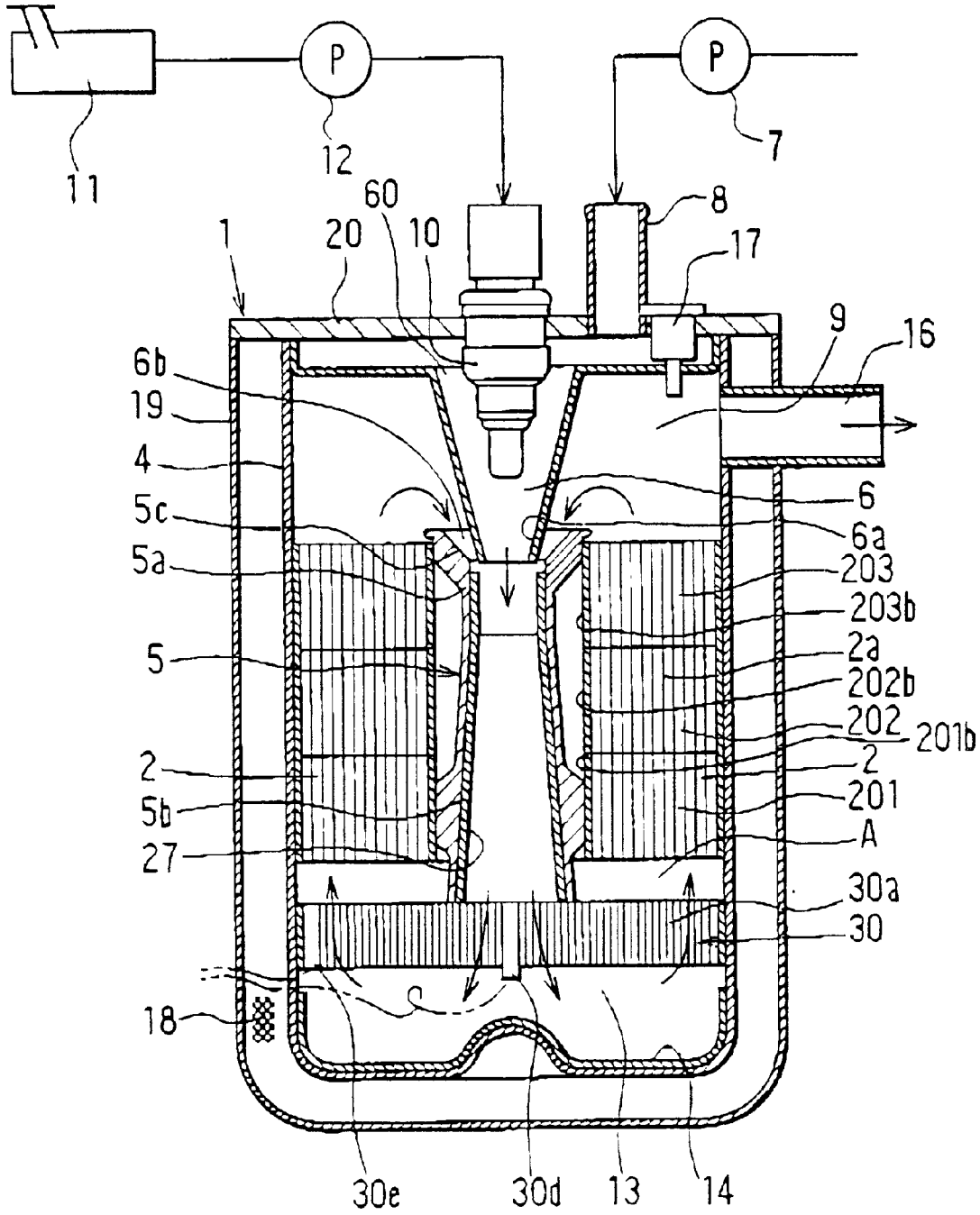
FIG. 15 is a longitudinal cross sectional view showing a ninth embodiment of the present invention.

In FIG. 15, the main catalyst body 2 in the aforementioned eighth embodiment is divided in the flow direction of the air for combustion (in the vertical direction of the drawing) into a plurality of, e.g., three blocks 201, 202 and 203. Moreover, the activated temperature of the catalyst is made to be lower as going to the more upstream side (i.e., for the block the closer to the premixing chamber 13) with reference to the flow of the air for combustion, that is, the closer to the block 201 from the block 203.

In this embodiment, the amount of the carried catalyst (i.e., the ratio of the catalyst weight to the total weight of the catalyzer) is made to be larger as going from the block 203 to the block 201. Specifically, the amount of the catalyst is set at 0.5 wt. % for the block 203, at 1.0 wt. % for the block 202, and at 1.5 wt. % for the block 201. As a result, the block 201, as positioned at the more upstream side with reference to the flow of the air for combustion, can be activated at the lower temperature. According to preparatory tests using propylene gas, the catalyst activating temperature was 180° C. for 1.5 wt. % of Pt, 200° C. for 1.0 wt. % of Pt, and 250° C. for 0.5 wt. % of Pt.

As a result, in the upstream block 201 of the main catalyst body 2, the catalyst can be activated immediately after the start of the electric power supply to the starting catalyst body 30, so that the fuel flow amount can be accordingly increased early to expand the activation area of the main catalyst body 2 rapidly.

As a result, according to the ninth embodiment, the combustion amount can be shifted earlier to the maximum value than the case in which the amount of carried catalyst in the main catalyst body 2 is set constant at 0.5 wt. % all over the area. Thus, it is possible to enhance the heating effect of the passenger compartment rapidly.

As compared with the case in which the amount of carried catalyst in the main catalyst body 2 is set constant at 1.5 wt. % all over the area, the amount of the expensive catalyst can be reduced to lower the cost without any substantial change in the time period for the combustion amount shifted to the maximum value.

It is advantageous not only at the warming starting time but also in the steady combustion, for the main catalyst body 2 to be divided into the plurality of blocks 201 to 203 such that the more catalyst is carried on the more upstream block. In other words, the combustion apparatus according to the present invention depends upon used circumstances such that it is not always used at the maximum combustion amount but could desirably be used over a wide combustion range. In the catalytic combustion, the combustion temperature will generally drop to the lower value for the finer combustion, and the reaction is completed at the upstream side of the catalyst.

By activating the upstream catalyst block 201 at a low temperature, the catalytic combustion can be effected up to the fine combustion range.

As means for lowering the activation temperature of the catalyst body, other than by increasing the amount of carried catalyst, the size of the catalyst body may be made smaller at the more upstream side (e.g., at the portion closer to the premixing chamber 13, as shown in FIG. 1) with reference to the flow of the air for combustion, or the combination of reducing amount of carried catalyst and reducing the size of the catalyst body may be also available.

Moreover, the material itself of the catalyst may be altered (e.g., by adding Rh) to make the activation temperature to be lower at the more upstream side with reference to the flow of the air for combustion.

In this embodiment, the main catalyst body 2 is divided into the three blocks 201 to 203; however, the number of divided blocks should not be limited to three but could be suitably changed according to the combustion raising time period, the manufacture cost, or the like, as needed.

Alternatively, without dividing the main catalyst body 2 into the plurality of blocks 201 to 203 and with single main catalyst body 2, the larger amount of carried catalyst is provided at the more upstream side.

A tenth embodiment of the present invention will be described with reference to FIG. 16.

Figure 16:
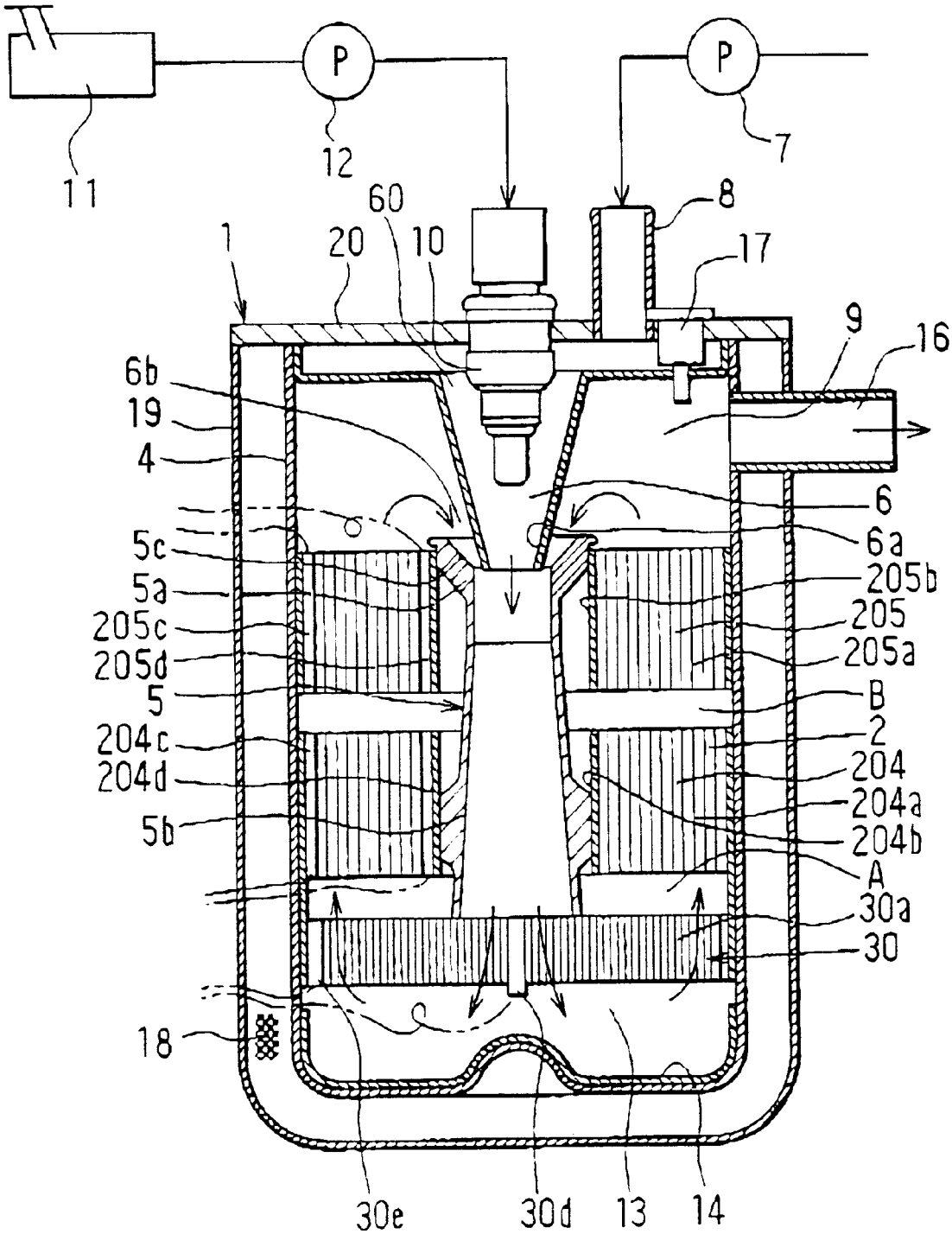
FIG. 16 is a longitudinal cross sectional view showing a tenth embodiment of the present invention.

In FIG. 16, the main catalyst body 2 in the eighth embodiment is halved, and these two halved catalyst bodies are made of electrically conductive catalyst bodies 204 and 205, which are disposed to form a small gap B (of about 5 mm) therebetween. The catalyst carriers 204*a* and 205*a* of those electrically conductive catalyst bodies 204 and 205 are made to be electrically conductive by the same construction of the starting catalyst body 30 in the eighth embodiment.

In the two electrically conductive catalyst bodies 204 and 205 of this embodiment, respectively, there are disposed the positive electrode terminals 204*d* and 205*d* at inner circumferential portions thereof and the negative electrode terminals 204*c* and 205*c* at outer circumferential portions thereof. These three components, i.e., the starting catalyst body 30 and the two electrically conductive catalyst bodies 204 and 205 are electrically connected in parallel with each other.

When a temperature of the outside air is extremely low such as −20° C., although a rapid heating is required, it is difficult to activate the catalyst early. According to the tenth embodiment, the three catalysts, i.e., the starting catalyst body 30 and both of the electrically conductive catalyst bodies 204 and 205, can be directly heated by the electric heating actions of the carriers 204*a*, 205*a* and 30*a* , when three of the starting catalyst body 30 and the electrically conductive catalyst bodies 204 and 205 are simultaneously electrified so that these catalyst bodies can be activated early. As a result, the time period for raising the combustion can be shortened even at the extremely low temperature.

When a temperature of the outside air is comparatively high (e.g., 10° C. or higher), the catalyst can be efficiently preheated according to the situations of the temperature of the outside air or the like, by electrifying only the starting catalyst body 30 without electrifying the two electrically conductive catalyst bodies 204 and 205.

Even when the temperature of the outside air is comparatively high; however, the aforementioned three catalysts may be electrified to raise the combustion early.

In the tenth embodiment, the main catalyst body 2 need not be divided into the plurality but may be a single one such that only a portion at the upstream side of the air for combustion is made of an electrically conductive catalyst body. Similar to the ninth embodiment, the number of divisions and the size of the main catalyst body 2 could be modified in various manners. Further, the two electrically conductive catalyst bodies 204 and 205 may be constructed such that a larger amount of catalyst is carried on the electrically conductive catalyzer 204 at the upstream side whereas a smaller amount of catalyst is carried on the electrically conductive catalyst 205 at the downstream side.

An eleventh embodiment of the present invention will be described with reference to FIG. 17.

Figure 17:
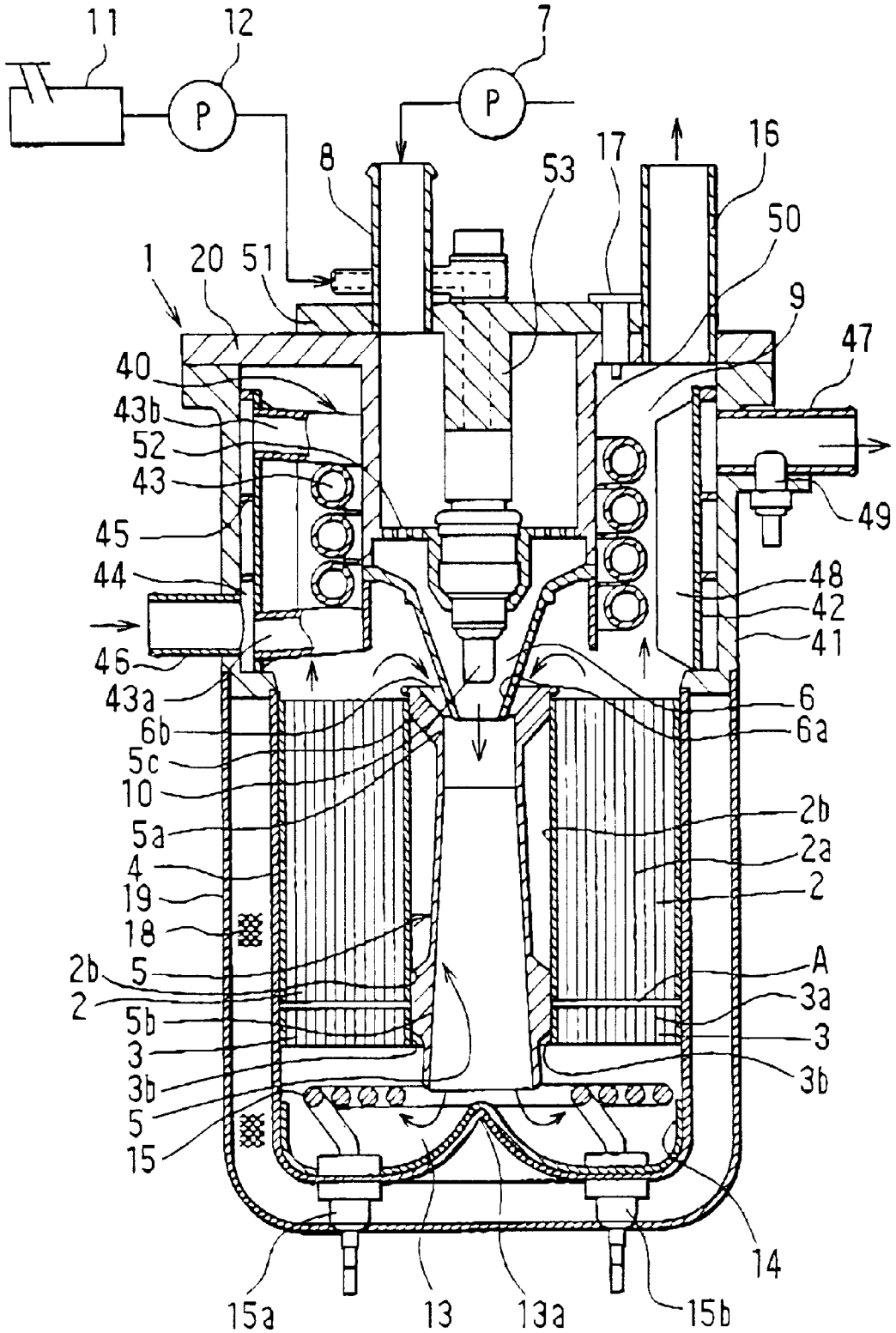
FIG. 17 is a longitudinal section showing an eleventh embodiment of the present invention.

In FIG. 17, the heat exchanger in the first embodiment of FIG. 1 for exchanging the heat between the hot exhaust gas (combustion gas) and the heat transfer medium (e.g., water) is compact and integrated with the inside of the catalyst combustion apparatus.

As shown in FIG. 17, a heat exchanger 40 for exchanging the heat between the high-temperature exhaust gas and the heat transfer medium is disposed between the combustion cylinder 4 and the upper end plate 20 and at outer circumferential sides of the passages for supplying the air for combustion and the fuel. This heat exchanger 40 is constructed to include a cylindrical outer cylinder 41, an inner cylinder 42, and a coil 43. The cylindrical space between the outer cylinder 41 and the inner cylinder 42 is partitioned into a spiral passage 44 by a spiral partition plate 45.

At one end portion of the spiral passage 44, there is disposed an inlet pipe 46 for the heat transfer medium, which is fixed on the outer cylinder 41. At the other end portion (located at a position symmetric by 180 degrees in the circumferential direction of the outer cylinder 41), there is disposed an outlet pipe 47 for the heat transfer medium, which is fixed on the outer cylinder 41.

The coil 43 is structured by bending a hollow pipe spirally, and an inlet portion 43*a* thereof is joined to the spiral passage 44 just after the portion where the inlet pipe 46 is disposed so that the heat transfer medium from the inlet pipe 46 may flow into the passage 44 and into the inlet portion 43*a* of the coil 43.

An outlet portion 43*b* of the coil 43 is joined to the spiral passage 44 in the vicinity of a portion close to the outlet pipe 47 so that the heat transfer medium flowing out from the outlet portion 43*b* may join the heat transfer medium in the passage 44 and then flow to the outlet pipe 47. In short, the heat transfer medium flows in parallel in the coil 43 and the spiral passage 44. On the inner circumferential side of the inner cylinder 42, there are radially disposed a plurality of sheet fins 48 to form a minute gap (e.g., about 4.5 mm) therebetween, and these sheet fins 48 are joined to the inner circumferential wall of the inner cylinder 42.

Each of the members 41 to 43 and 45 to 48 of the heat exchanger 40 is preferably made of aluminum in view of thermal conductivity, and each of connecting portions is brazed, for example. As the heat transfer medium, a non-freezing solution having a freezing point as low as about −30° C. is employed in this embodiment; however, water or air may be employed in accordance with the situations where the combustion apparatus is used.

Moreover, the heat transfer medium having flow out from the outlet pipe 47 is pumped by the hot water pump (not shown) to a heater core (heating heat exchanger) disposed in the air passage of the heating system for the vehicle. In the heater core, the heat exchange is performed between the air supplied by a blower and the heat transfer medium to heat the air so that the heated warm air may be blown out into the passenger compartment. In the outlet pipe 47, there is disposed a heat transfer medium temperature detector 49 for detecting the temperature of the heat transfer medium.

In this embodiment, accompanying the aforementioned heat exchanger 40, there is formed a suction cylinder 50 integrally with the central portion of the upper end plate 20. This suction cylinder 50 is disposed to extend inside the central portion of the coil 43. The suction cylinder 50 is closed at one end portion thereof (the upper end portion of FIG. 17) by a cover 51, and the air inlet B is provided in the cover 51 to introduce the air for combustion into the suction cylinder 50.

At the other end side (the lower end portion of FIG. 17) of the suction cylinder 50, there is disposed a current plate 52 which has a plurality of holes for smoothing the flow of the air for combustion. The fuel nozzle 10 is mounted on a central portion. The primary nozzle 6 is mounted on the other end portion of the suction cylinder 50. To the fuel nozzle 10, there is connected a fuel pipe 53 which is formed in the cover 51 so that the fuel from the fuel pump 12 is supplied through the fuel pipe 53.

An operation of the eleventh embodiment will be described. A part of the heat transfer medium (non-freezing solution) having entered the spiral passage 44 of the heat exchanger 40 from the inlet pipe 46 flows in the coil 43, and the remaining heat transfer medium (non-freezing solution) flows in the spiral passage 44. In this meanwhile, the heat transfer medium is heated to a high temperature by exchanging the heat with the exhaust gas (combustion gas) through the fins 48 and by exchanging the heat directly with the exhaust gas (combustion gas) on the outer surface of the coil 43. Moreover, the flows of the two heat transfer medium join together at an upstream side of the outlet pipe 47 and flows out therethrough.

The heating capacity is controlled by increasing or decreasing the combustion amount according to the temperature detected by the heat transfer medium temperature detector 49.

According to the construction and operations as described above, the highly efficient heat exchanger 40 having a compact construction can be integrated with the catalyst combustion apparatus. In the flame combustion, the carbon produced during the combustion is generally adhered to fill up the gaps between the adjacent fins 48 to lower the heat exchanging efficiency. In the catalytic combustion according to the present invention, on the contrary, little carbon is produced so that the gaps between the adjacent fins 48 can be maintained at the aforementioned value as small as about 4.5 mm to improve the heat exchanging efficiency.

The other constructions and effects are the same as those of the first embodiment.

A twelfth embodiment of the present invention will be described with reference to FIG. 18.

Figure 18:
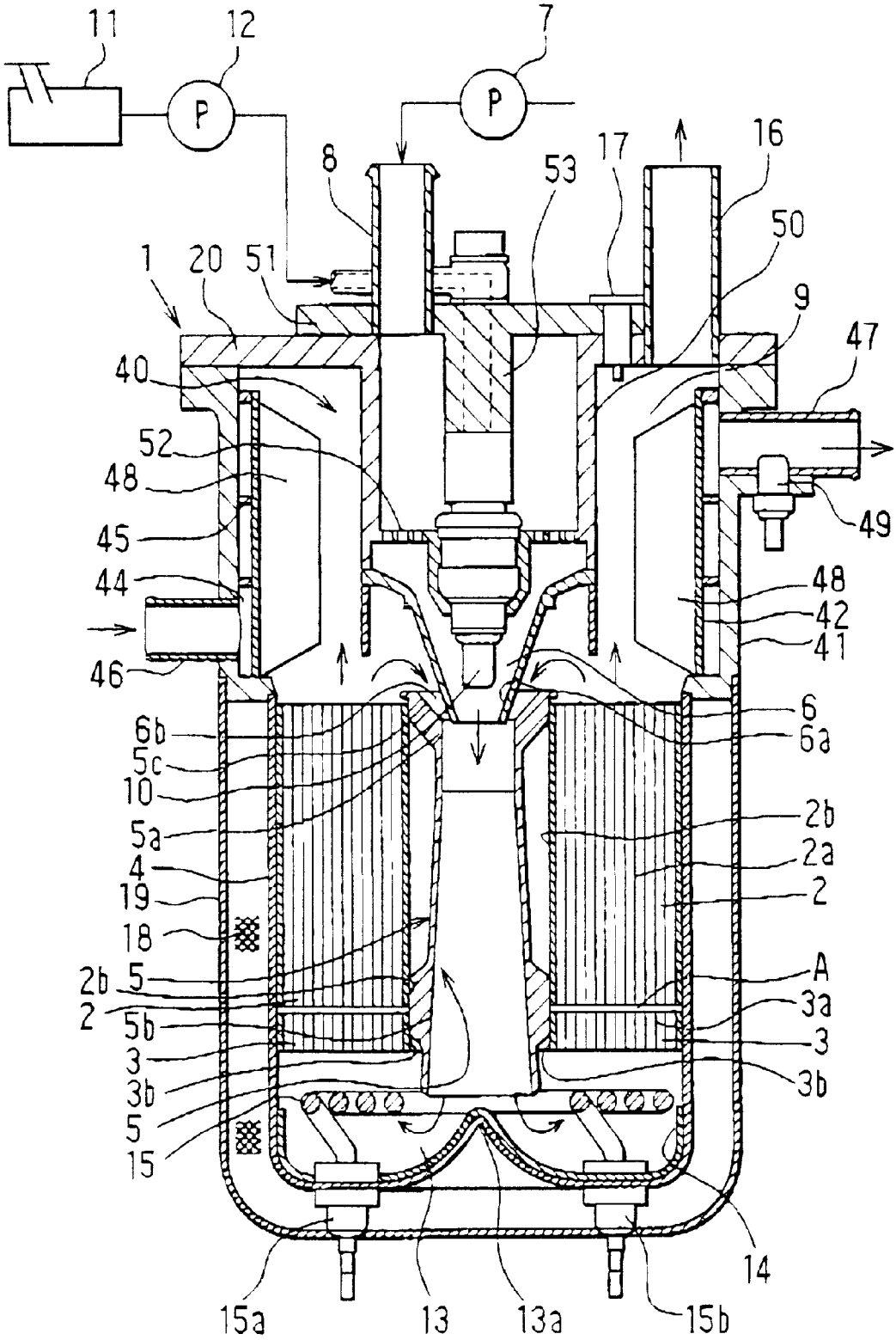
FIG. 18 is a longitudinal section showing a twelfth embodiment of the present invention.

In FIG. 18, the coil 43 is omitted from the eleventh embodiment of FIG. 17. In this way, the construction of the heat exchanger 40 can be simplified, although the heat exchanging efficiency between the heat transfer medium and the exhaust gas drops.

Figure 19:
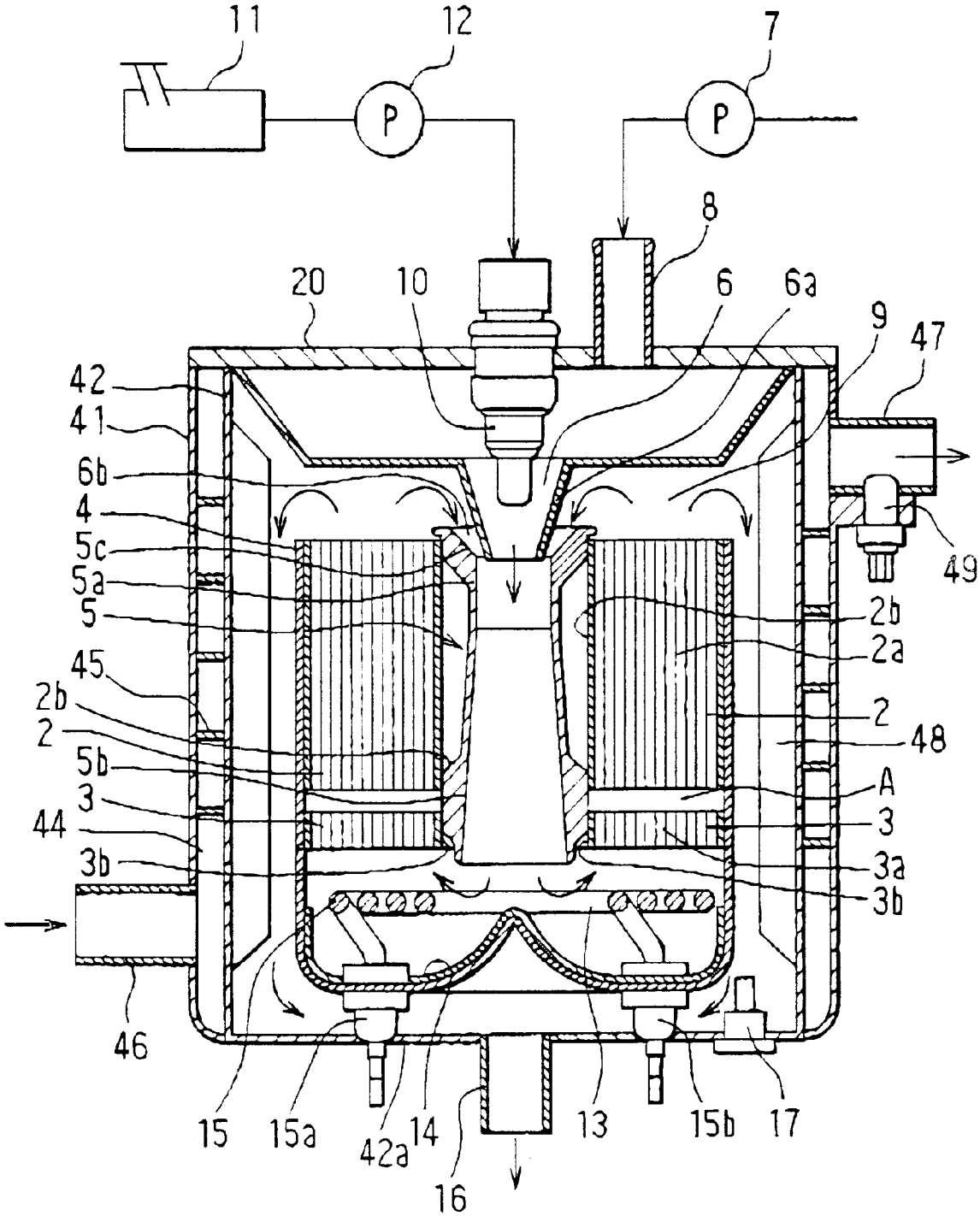
FIG. 19 is a longitudinal section showing a thirteenth embodiment of the present invention

A thirteenth embodiment of the present invention will be described with reference to FIG. 19.

In the eleventh and twelfth embodiments of FIGS. 17 and 18, the heat exchanger 40 for exchanging the heat between the hot exhaust gas and the heat transfer medium is disposed between the combustion cylinder 4 and the upper end plate 20. In the thirteenth embodiment, on the contrary, the heat exchanger 40 is disposed at outer circumferential sides of the catalyst bodies 2 and 3.

In the thirteenth embodiment, more specifically, the heat exchanger 40 is disposed at outer circumferential sides of the catalyst bodies 2 and 3, and the radial fins 48 are disposed at an outer circumferential side of the combustion cylinder 4 to form a minute gap therebetween. At the same time, the spiral passage 44 is formed by the spiral partition plate 45 between the inner cylinder 42 and the outer cylinder 41 disposed at outer circumferential sides of those radial fins 48. As a result, the outer cylinder 41 functions as the cover 19 in the foregoing first to twelve embodiments.

Moreover, a bottom plate 42*a* of the inner cylinder 42 is disposed outside the premixing chamber 13 (at the lower side of FIG. 19) to form a predetermined gap therebetween, and the exhaust gas outlet 16 is formed in the central portion of the bottom plate 42*a*. As a result, the exhaust gas having flowed out of the main catalyst body 2 makes a U-turn in the exhaust gas chamber 9 and passes through the outer circumferential side of the combustion cylinder 4. Further, the exhaust gas flows in the downward direction of FIG. 19 and flows out through the exhaust gas outlet 16.

According to the thirteenth embodiment, the exhaust gas flows on the outer circumferential side of the combustion cylinder 4, and the heat transfer medium passes through the spiral passage 44 which is disposed at an outer circumferential side of the combustion cylinder 4 and is heat-exchanged with the exhaust gas. As a result, the heat radiated from the outer circumferential sides of the catalyst bodies 2 and 3 can be suppressed by the flow of the high-temperature exhaust gas so that the catalyst bodies 2 and 3 can be more easily maintained in the high-temperature state than the constructions of the first to twelfth embodiments. In this way, it is possible to always maintain the catalytic combustion satisfactorily.

At the same time, it is advantageous that the insulator 18 at the outer circumferential side of the combustion cylinder can be omitted unlike the first to twelfth embodiments.

In the combustion apparatus according to the thirteenth embodiment, the size in the axial direction is made smaller and the size in the radial direction is made larger as compared with the constructions of the eleventh and twelfth embodiments in which the heat exchanger is integrated. In this way, it is possible to improve the performance where the combustion apparatus is mounted on the vehicle.

In the thirteenth embodiment, the spiral coil 43 of the eleventh embodiment is omitted; however, the spiral coil 43 may be disposed in the fins 48 like the eleventh embodiment.

In each of the foregoing embodiments, the catalyst body is divided into the starting catalyst body 3 and the main catalyst body 2 to activate the catalyst early; however, these two catalyst bodies 2 and 3 may be constructed by one catalyst body.

Moreover, in the time charts of FIGS. 3 and 14, the increase in the combustion range after the lapse of the predetermined time period of (t1+t2) from the switch ON of the operation switch 22 may be either continuous or stepwise.

Moreover, the operation time period for the post purge is set in FIG. 3 to the predetermined value t4 by the timer. In place of the determination by the time, however, the post purge operation may be stopped when the detected temperature of the temperature detector 17 lowers to a predetermined value after the start of the post purge operation.

In the first embodiment, the fuel nozzle 10 is of the type in which the nozzle is opened to spray the fuel when the pressure for supplying the fuel by the fuel pump 12 exceeds a predetermined value. However, the fuel nozzle 10 may be of a two-fluid spray type for spraying the fuel and the air simultaneously. Further, the fuel nozzle 10 may be an ultrasonic nozzle for atomizing the liquid fuel by ultrasonic waves, or the injector having an electric heater, which is used for cold-starting an internal combustion engine of the vehicle.

Here, when the electromagnetic injector, as well known in the vehicle or the like, is employed as the fuel nozzle 10, by controlling the time period for electrifying the electromagnetic coil of the injector, the fuel supply amount can be controlled. As a result, the rotational speed of the fuel pump 12 can be maintained constant so that the fuel supply pressure is maintained at a constant value.

In the fifth and sixth embodiments, the fuel absorber 27 is disposed in the exhaust gas mixing cylinder 5. However, the fuel absorber 27 may be omitted, and a groove portion of spiral shape or the like may be formed in the inner wall surface of the exhaust gas mixing cylinder 5 to enhance the fuel holding effect to improve the evaporation of the fuel.

Next, a fourteenth embodiment of the present invention will be described with reference to FIGS. 20–22. In the fourteenth embodiment, the catalyst apparatus in the first embodiment is modified so that the cleanness of the combustion is further improved by increasing a turn-down ratio (TDR). TDR is a ratio of the maximum combustion amount with respect to the minimum combustion amount in the combustion apparatus.

Figure 20:
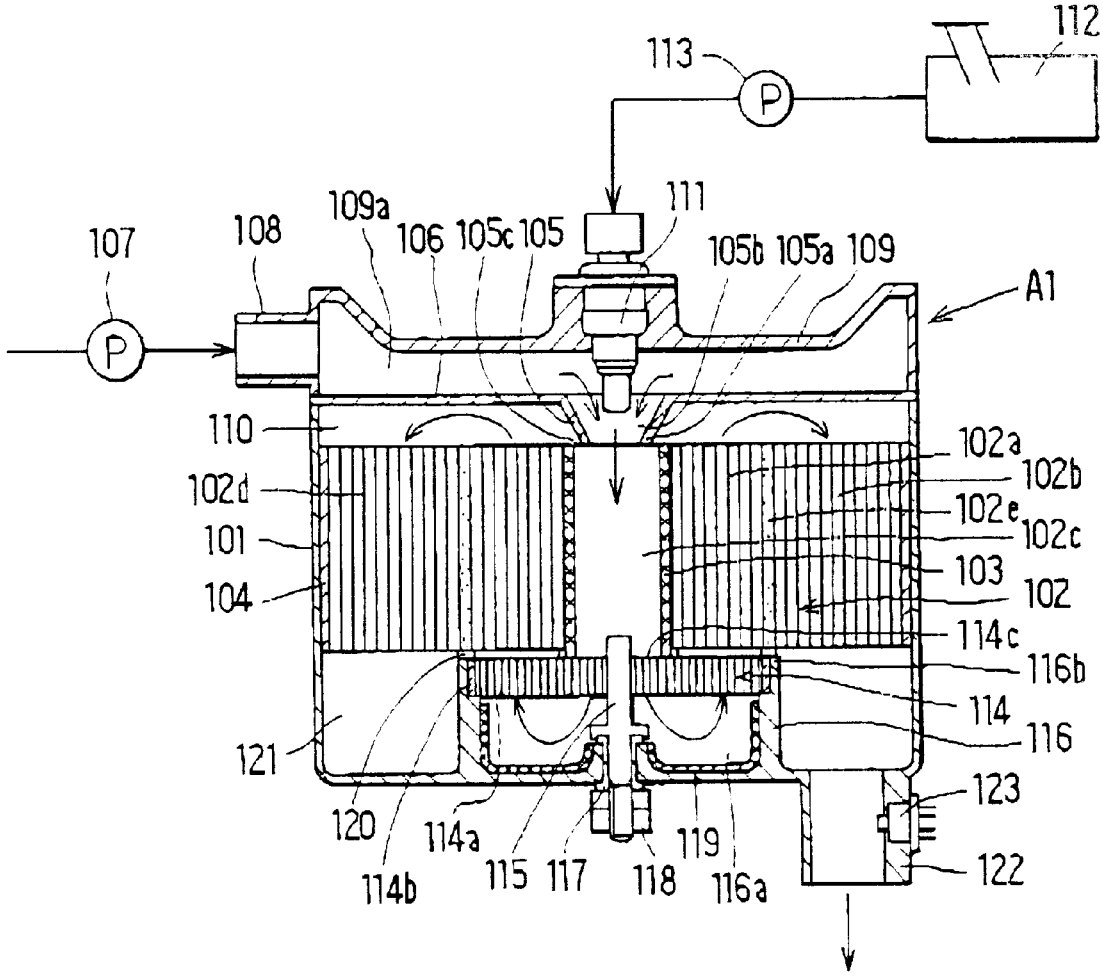
FIG. 20 is a longitudinal cross sectional view showing a combustion apparatus in a fourteenth embodiment.

Specifically, as shown in FIG. 20, a combustion apparatus A1 in the fourteenth embodiment has a combustion cylinder 101 having a bottom wall, and a main catalyst body 102 is accommodated in the combustion cylinder 101. The main catalyst body 102 has a honeycomb carrier 102*d* having a plurality of vertically penetrating communication holes, and catalysts of noble metals such as Pt, Pd are held on the surface of the carrier 102*d*. The honeycomb carrier 102*d* has a cylindrical shape with a through hole 102*c* at the central portion thereof such that the carrier 102*d* has a ring-like shape in cross-section. The carrier 102*d* can be made by baking a member molded by extruding a powdery mixture of ceramic materials or of heat-resistant metallic materials, or be made by rolling up flat plates and corrugated plates made of metal.

The carrier 102*d* is integrally composed of an inside catalyst member (first catalyst member) 102*a* having the through hole 102*c* therein and an outside catalyst member (second catalyst member) 102*b* having the outer circumferential side face of the cylindrical shape. The carrier 102*d* further has a cylindrical communication hole 102*e* between the inside catalyst member 102*a* and the outside catalyst member 102*b*, specifically, between the outer circumferential face of the inside catalyst member 102*a* and the inner circumferential face of the outside catalyst member 102*b*. The communication hole 102 is filled with cordierite or the like. A ratio in volume of the inside catalyst member 102*a* and the outside catalyst member 102*b* is controlled in accordance with combustion amounts required for the inside and outside catalyst members 102*a*, 102*b*, and is set for example 1:2 in this embodiment.

A porous fuel evaporation member (fuel absorber) 103, which is made of for example wire mesh, a foam metallic member, or a porous ceramic member, for temporarily absorbing fuel to vaporize it is disposed on the inner circumferential face of the through hole 102*c* of the main catalyst body 102. A heat insulating material (insulator) 104 is disposed over between the outer circumferential side face of the main catalyst body 102 and the inside wall of the combustion cylinder 101, so that the main catalyst body 102 is supported by the inside wall of the combustion cylinder 101 through the heat insulating material 104.

A side plate 106 covers an upper end face of the combustion cylinder 101, and a primary nozzle 105 is disposed at the central portion of the side plate 106 to face an end of the inside catalyst member 102*a*. The primary nozzle 105 is made of heat-resistant metal, and has a funnel-shaped throttle portion 105*a* at the lower end side thereof. A case 109 is disposed on the side plate 106 to define an air conducting chamber 109*a* with the side plate 160. The inside and outside of the case 109 communicates with each other through an air inlet 108, and air for combustion is supplied through the air inlet 108 by an air pump (combustion air supply unit) 107 into the air conducting chamber 109*a*. The air conducting chamber 109*a* conducts the air to the primary nozzle 105.

A fuel injection nozzle (fuel nozzle) 111 is fixed to the upper wall of the case 109 such that it coaxially faces a passage 105*b* of the primary nozzle 105. Liquid fuel such as kerosene diesel fuel, gasoline, or alcohol supplied from a fuel tank 112 by a fuel pump 113 is sprayed by the fuel injection nozzle 111 in an axial direction of the through hole 102*c* of the main catalyst body 102. That is, the air for combustion and the liquid fuel are supplied together to the through hole 102*c* of the main catalyst body 102 thought the throttle portion 105*a*, i.e., through the passage 105*b*. In this embodiment, the fuel injection nozzle 111 and the fuel pump 11 constitute a fuel supply unit.

A turning chamber 110 is provided between the side plate and the upper end face of the main catalyst body 102, i.e., on the outer circumferential side of the primary nozzle 105. That is, the turning chamber 110 is provided on a downstream side of the inside catalyst member 102*a* and on an upstream side of the outside catalyst member 102*b* to conduct combustion gas from the inside catalyst member 102*a* to the outside catalyst member 102*b* by turning the flowing direction of the combustion gas therein. The primary nozzle 105 is coaxial with the through hole 102*c* of the main catalyst body 102, and forms a ring-shaped secondary nozzle (return passage) 105*c* between the throttle portion 105*a* thereof and the through hole 102*c*. The turning chamber 110 communicates with the through hole 102*c* of the main catalyst body 102 through the secondary nozzle 105*c*. The secondary nozzle 105*c* is for returning part of the combustion gas from the turning chamber 110 into the through hole 102*c* of the main catalyst body 102.

A starting catalyst body 114 is disposed to face the inside catalyst member 102*a* and the through hole 102*c* on the downstream side of the through hole 102*c* and on the upstream side of the inside catalyst member 102*a*. The starting catalyst body 114 is energized to develop heat, reacts, and accordingly preheats the main catalyst body 102 by radiation and convection therefrom in the combustion cylinder 101. The starting catalyst body 114 has a disc-like honeycomb 114*a* having a diameter approximately the same as that of the inside catalyst member 102*a*, and a central electrode (electric heater) 115 provided at the central portion of the honeycomb 114*a*.

The honeycomb 114*a* can be made by rolling up a conductive metallic foil such as a stainless foil (SUS 430) with a corrugated state to have a honeycomb like shape, or be made by extruding a sintered metal to form a monolithic shape. Catalysts such as Pt are held on the honeycomb 114*b* of the stating catalyst body 114. The central electrode 115 is fixed to a bottom wall of a premixing chamber 116 which is discussed below, and accordingly the stating catalyst body 114 is disposed to face the inside catalyst member 102*a* on the lower end side of the inside catalyst member 102*a*. Specifically, the central electrode 115 penetrates the bottom wall of the premixing chamber 116 and is fixed to the bottom wall by a fastening nut 118 while being insulated from the bottom wall by an insulating member 117 interposed therebetween. Accordingly, the central electrode 115 becomes a state capable of being connected to a control unit (ECU) 124 discussed below.

An outer cover 114*b* is disposed on the outer circumferential side face of the honeycomb 114*a*, and the honeycomb 114*a* is supported by the inside wall of the premixing chamber 116 through the outer cover 114*b*. Accordingly, an electrical passage of the stating catalyst body 114 is provided by the central electrode 115, the honeycomb 114*a*, the outer cover 114*b*, and the inside wall of the premixing chamber 116, and is electrically grounded to the combustion cylinder 101.

The premixing chamber 116 is for mixing the liquid fuel and the air therein, and is provided on the lower end side of the main catalyst body 102 and of the starting catalyst body 114 in the combustion cylinder 101. The premixing chamber 116 defines a premixing space 116*a* therein for changing the flowing direction of the air and the liquid fluid discharged from the through hole 102*c* to conduct them into the starting catalyst body 114 and into the inside catalyst member 102*a*. Because of this, the starting catalyst body 114 is disposed to adjacently face the inside catalyst member 102*a*.

A fuel evaporation member (absorber) 119 made of heat resistant metal is disposed with a large area to cover the side wall and the bottom wall inside the premixing chamber 116. The fuel evaporation member 119 is, like the evaporation member 103, to vaporize the liquid fluid to facilitate the mixing with the air. The fuel evaporation member 119 can be made from a foam metallic member, a porous ceramic thin plate, or the like in place of the gauze-like member such as wick.

Further, a ring-shaped packing 120 is hermetically disposed between the ring-shaped upper end face 116*b* of the outer circumferential side wall of the premixing chamber 116 and the carrier 102*d* at the position corresponding to the communication hole 102*e* being the boundary between the inside and outside catalyst members 102*a*, 102*b*. Accordingly, the current flowing from the premixing chamber 116 and the starting catalyst body 114 is securely conducted into the inside catalyst member 102*a* without flowing toward the downstream side of the outside catalyst member 102*b*. In this case, because the main catalyst body 102 has the honeycomb structure and the boundary between the catalyst members 102*a*, 102*b* of the main catalyst body 102 abuts the upper end face 116*b* of the outer circumferential side wall of the premixing chamber 116 via the packing 120, the boundary is necessarily closed with respect to the current flowing from the premixing chamber 116. Therefore, it is not always necessary for the communication hole 102*e* to be filled with material such as cordierite.

In this embodiment, the portion accommodating the catalyst bodies 102, body 114 constitutes a combustion chamber within the combustion cylinder 101. The combustion cylinder 101 further has an exhaust gas chamber 121 therein on the lower end side, i.e., on the downstream side of the outside catalyst member 102*b*, around the premixing chamber 116. That is, the exhaust gas chamber 121 is surrounded by the outer circumferential side wall of the premixing chamber 116, the lower end face of the outside catalyst member 102*b*, and the combustion cylinder 101, and serves as a passage for conducting the combustion gas (exhaust gas) from the outside catalyst member 102*b*. The exhaust gas flowing in the exhaust gas chamber 121 heats the premixing chamber 116 to facilitate the vaporization of the fuel in the premixing chamber 116.

The bottom wall of the exhaust gas chamber 121 has an exhaust gas outlet 122 for discharging the exhaust gas from the outside catalyst member 102*b*. A temperature detector (thermistor) 123 is disposed in the exhaust gas chamber 121 in the vicinity of the exhaust gas outlet 122. The exhaust gas discharged from the exhaust gas outlet 122 is sent to the heat exchanger (not shown), in which a heat exchange is performed between the exhaust gas and the water to heat the water. The heated hot water is pumped to a heater core of an air conditioner, so that conditioning air is heated by the heater core to heat a passenger compartment of a vehicle.

Figure 21:
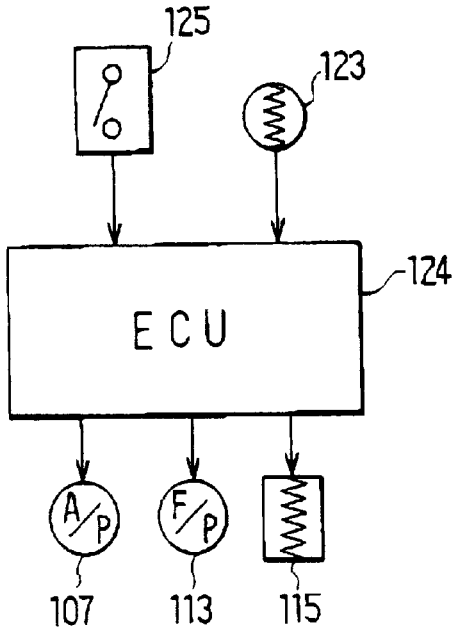
FIG. 21 is a block diagram showing an electric control in the fourteenth embodiment.

FIG. 21 is a block diagram showing an electric control of this embodiment. The control unit (ECU) 24 is for controlling the aforementioned electric devices 107, 113, 115 in the combustion apparatus A1, and numeral 125 denotes an operation switch of the combustion apparatus A1.

An operation of the above-described construction will be described. When the operation switch 25 is turned ON, first, the central electrode 115 is electrified and the starting catalyst body 114 develops heat. Accordingly, the inside catalyst member 102*a* and the fuel evaporation members 119, 103 are preheated by radiation heat and natural convection caused by the heat from the starting catalyst body 114.

Figure 22:
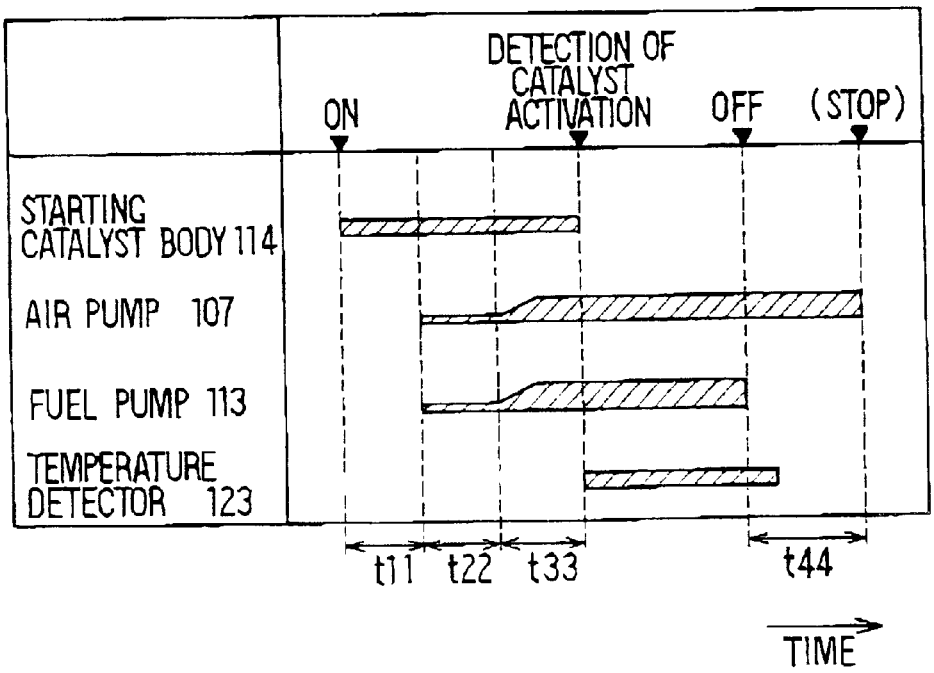

Referring to FIG. 22, when a predetermined time period t11 is elapsed after the switch ON of the operation switch 125, the air pump 107 and the fuel pump 113 are electrified by a timer in the control unit 124 so that the supply of the air and the fuel are started. First, amounts of the air and the fuel to be supplied are suppressed (e.g., approximately one tenth of that in the maximum combustion amount) by lowering the rotational speeds of both pumps 107, 113 with the control unit 124. This is because when a large amount of the air flows from the beginning, the starting catalyst body 114 and the fuel evaporation members 119, 103 are easily cooled. In this ease, sufficient catalytic reaction may not occur.

The liquid fuel is sprayed from the fuel injection nozzle 111 toward the through hole 102*c* through the passage 105*b* of the primary nozzle 105, whereas the air for combustion is supplied from the air inlet 108 to the primary nozzle 105 through the air conducting chamber 109*a*. The liquid fuel sprayed from the nozzle 111 is evaporated at the central portion 114*c* of the starting catalyst body 114 and on the fuel evaporation members 119, 103, and is mixed with the air in the premixing space 116 while changing its flowing direction (that is, making a U-turn) in the premixing chamber 116. Accordingly, the air-fuel mixture flows upward into the starting catalyst body 114 and undergoes oxidizing reaction to produce high temperature combustion gas in the starting catalyst body 114.

The inside catalyst member 102*a* of the main catalyst body 102 is rapidly heated by the radiation and the high-temperature combustion gas from the starting catalyst body 114 so that it is activated. Then, when a predetermined time period t22 is elapsed since the supply of the fuel and the air is started, the rotational speeds of the two pumps 107, 113 are increased by the control unit 124 so that the combustion amount is gradually increased. Accordingly, the air-fuel mixture starts to react in the inside catalyst member 102*a*, so that the temperature of the combustion gas is further increased. Part of the high-temperature combustion gas discharged from the inside catalyst member 102*a* passes through the secondary nozzle 105*c* to circulate again, and the rest of the high-temperature combustion gas changes its flowing direction again in the turning chamber 110 to flow into the outside catalyst member 102*b*.

The combustion gas heats and activates the outside catalyst member 102*b* while being flowing downward in the outside catalyst member 102*b*, so that the reaction of the combustion gas is finished in the outside catalyst member 102*b*. The combustion gas discharged into the exhaust gas chamber 121 has higher temperature raised in the outside catalyst member 102*b*, and is then discharged from the exhaust gas outlet 122 as the exhaust gas.

When the temperature detected by the temperature detector 123 reaches a predetermined temperature (e.g., about 300° C.–500° C. in case of the kerosene fuel) after a predetermined time period t33 is elapsed, it is then determined that the main catalyst body 102 is entirely activated. Based on the determination, the control unit 124 stops to supply electricity to the central electrode 115. From now on, the combustion shifts to steady combustion while the exhaust gas temperature is detected by the temperature detector 123.

In the steady combustion, the air is heated by exchanging heat with the combustion through the side plate 106 in the air conducting chamber 109*a* and by being mixed with the combustion gas circulating again in the through hole 102*c*. The side plate 106 can have enlarged heat transfer surfaces (heat transfer fins) on the air conducting chamber side and on the turning chamber side, or may have an enlarged heat transfer surface at least on one side. Accordingly, the heat exchanging effect of the air can be further enhanced. Incidentally, the reaction of the air-fuel mixture is approximately finished in the inside catalyst member 102*a*. Therefore, even in a low heat load state, the temperature of the combustion gas returned into the through hole 102*c* to circulate is approximately the same as that of the combustion gas discharged from the outside catalyst member 102*b*. As a result, a preheating operation of the air for combustion, which is especially required in a cold district, is performed without always using an electrothermic intake heater or the like so that the air keeps its temperature necessary for the steady combustion (for example approximately 200° C. in case of the kerosene fuel).

Incidentally, during the combustion, an ejector effect occurs by supplying, more specifically by jetting the air by the throttle portion 105*a* toward the through hole 102*c* while increasing the speed of the air current. Accordingly, a pressure in the vicinity of the secondary nozzle 105*c* is reduced so that part of the combustion gas in the turning chamber 110 returns to the through hole 102*c* through the secondary nozzle 105*c*. The air-fuel mixture is mixed with the part of the combustion gas and flows to the downstream side of the through hole 102*c*. At that time, the flowing speed component is converted into a pressure so that the pressure is recovered. The air-fuel mixture then flows into the starting catalyst body 114, the inside catalyst member 102*a*, and the outside catalyst member 102*b*.

In the combustion apparatus A1 of this embodiment, part of the combustion gas flowing in the turning chamber 110 circulates again with the air for combustion. Accordingly, the high-temperature combustion gas preheats the air and facilitates the vaporization of the fuel injected from the fuel injection nozzle 111 and the mixture of the fuel with the air. In addition, the activated state of the inside and outside catalyst members 102*a,* 102*b* are maintained. Consequently, the catalytic combustion in the combustion apparatus A1 can be suitably performed even in the cold district. Also, because the temperature of the air in the air conducting chamber 109*a* can be increased due to heat exchange with the combustion gas through the side plate 106, the preheating effect is enhanced.

At the stop of combustion, the operation switch 125 is turned OFF. In response to the OFF operation, the control unit 124 instantly stops the fuel pump 113 but allows the air pump 107 to operate for a predetermined time period t44 so that the residual fuel in the combustion cylinder 101 is burned out and thereafter the combustion cylinder 104 is cooled (a post-purge operation). The temperature detector 123 operates for a while after the fuel pump 113 is stopped. After a lapse of the predetermined time period t44, all components are stopped by stopping the air pump 107.

According to this embodiment, because the fuel is supplied or stopped while the catalyst bodies 102, 114 are activated, emission is hardly discharged even at the time of ignition or extinction so that a clean combustion can be achieved.

Generally, to reduce the radiation loss, it is effective that the catalyst body has the minimum size having a surface area as small as possible to matches the minimum combustion amount, and simultaneously that the radiation heat transferring area is reduced. However, on the other hand, it is necessary to secure the size of the catalyst body sufficient for realizing the maximum combustion amount.

According to this embodiment, to comply with the two conflicting ideas, the air-fuel mixture first flows in the inside catalyst member 102*a,* and then flows in the outside catalyst member 102*b* disposed on the outer circumference of the inside catalystmember 102*a.* That is, the air-fuel mixture is burned in both of the inside and outside catalyst members 102*a* , 102*b.* Accordingly, in the inside catalyst member 102*a,* the adiabatic heat retaining property is provided and the activation of the catalysts is facilitated by the combustion heat from the outside catalyst member 102*b.* When the combustion amount is small, the catalytic reaction is almost finished in the inside catalyst member 102*a* in which the catalytic reaction activity is prevented from lowering and radiation loss is suppressed. When the combustion amount is large, the unburned gas is burned in the outside catalyst member 102*b* so that the catalytic reaction is completed. Therefore, the combustion apparatus A in this embodiment can provide the smaller minimum combustion amount and the larger TDR than the above-mentioned embodiments, and the clean combustion can be efficiently realized in a wide combustion amount range from the minimum combustion amount to the maximum combustion amount.

Also in this embodiment, because the size of the outside catalyst member 102*b* is set larger than that of the inside catalyst member 102*a* (for example inside: outside=1:2), the combustion amounts necessary for the catalyst members 102*a,* 102*b* can be provided. Also, because the upstream side of the inside catalyst member 102*a* is substantially separated from the downstream side of the outside catalyst member 102*b* by the outer circumferential side wall of the premixing chamber 116, it is not necessary to provide an extra partition member and the constitution of the combustion apparatus is simple.

Further, in this embodiment, because the catalyst members 102*a,* 102*b* are integrally formed with one another, the manufacturing cost is low. Because the exhaust gas chamber 121 is provided around the premixing chamber 116, the premixing chamber 116 can be heated by the exhaust gas in the exhaust gas chamber 121 so that the vaporization of the fuel is facilitated. As a result, the air-fuel mixture is readily produced. The other effects are the same as those in the above-mentioned embodiments.

Next, fifteenth to nineteenth embodiments will be described referring to FIGS. 23–28 in sequence, focusing on points differing from the fourteenth embodiment. In FIGS. 23–28, the same parts as that shown in FIG. 20 are indicated with the same reference numerals and the same explanations will not be reiterated.

Herebelow, the fifteenth embodiment of the present invention will be described with reference to FIG. 23. Specifically, a combustion apparatus A2 of the fifteenth embodiment has a tube-fin type heat exchanger 130 for heating thermal medium (for example water) flowing therein by the high-temperature combustion gas (exhaust gas) undergone catalytic combustion. The heat exchange 130 is disposed on the outlet side (downstream side) of the outside catalyst member 102*b.*

The heat exchanger 130 is composed of a water tube 131 having an elliptic cross-section, a plurality of corrugated fins 132, an inlet pipe 133, and an outlet pipe 134. The corrugated fins 132 are joined to the outer surface of the water tube 131 and directly contact the combustion gas discharged from the outside catalyst member 102*b.* As shown in FIG. 24, the water tube 131 communicates with the inlet and outlet pipes 133, 134.

The thermal medium entered from the inlet pipe 133 flows in the water tube 131 while exchanging heat with the combustion gas and is discharged from the outlet pipe 134. The thermal medium discharged from the outlet pipe 134 is then transferred by a hot-water pump (not shown) to a heater core (heat exchanger for heater, not shown), which is disposed in an air passage of an automotive heater apparatus. In the air passage, the thermal medium exchanges its heat with air flowing in the air passage so that the air is heated, and the heated air is blown out into a passenger compartment of a vehicle.

The material for the heat exchanger 130 is for example stainless or aluminum, which is brazed to at joining portions. A water temperature detector 135 is disposed in the outlet pipe 134 on the outlet side of the thermal medium. An ECU compares the temperature detected by the water temperature detector 135 and a setting temperature to control the combustion amount. A heating capacity is controlled by the combustion amount. In this way, according to this embodiment, the heat exchanger 130 for heating the thermal medium is retained in the combustion apparatus A2, thereby providing the compact combustion apparatus. The other features and effects are those in the fourteenth embodiment.

Next, the sixteenth embodiment of the present invention will be described with reference to FIG. 25. In the sixteenth embodiment, a heat exchanger 140 is integrally formed with a catalyst combustion apparatus A3, in place of the heat exchange 130 in the fifteenth embodiment.

In FIG. 25, the heat exchanger 140 is for conducting heat exchange between the high-temperature combustion gas and thermal medium flowing in the heat exchanger 140, and is composed of an inside cylinder 141 disposed in the combustion cylinder 101 and a plurality of radial fins 142 attached to the inside cylinder 141. The inside cylinder 141 defines a cylindrical space with the combustion cylinder 101, and the cylindrical space is divided by a helical partition plate 143 to form a helical passage 144 therein. The exhaust gas chamber 121 is provided on the inner circumferential side of the inside cylinder 141, and the fins 142 are disposed in the exhaust gas chamber 121.

An inlet pipe 145 is disposed at an end of the helical passage 144 to introduce the thermal medium therein, and is fixed to the combustion cylinder 101. An outlet pipe 146 is disposed at the other end of the helical passage 144 to discharge the thermal medium therefrom, and is also fixed to the combustion cylinder 101. The outlet pipe 146 is disposed at a symmetrical position at 180° with respect to the inlet pipe 145 in a circumferential direction of the combustion cylinder 101 in FIG. 25. Thus the constitution of the heat exchange can be simplified in this embodiment. The thermal medium is heated by exchanging heat with the combustion gas in the helical passage 144, and then is transferred to the heater core (not shown). The control of heating capacity is controlled by using the ECU and the water temperature detector 135 substantially in the same manner as in the fifteenth embodiment. The other features and effects are the same as those in the fifteenth embodiment.

Next, the seventeenth embodiment will be described with reference to FIG. 26. In the fourteenth embodiment, as shown in FIG. 20, the main catalysts body 102 is composed of an integrally formed member in which only the flowing passage is divided into two parts. As opposed to this, in a catalyst combustion apparatus A4 of the seventeenth embodiment, an inside catalyst member 202*a* and an outside catalyst member 202*b* are separately formed, and a cylindrical separator 116*c* extending from the outer circumferential side wall of the premixing chamber 116 is disposed between the inside and outside catalyst members 202*a,* 202*b*. The ring-shaped upper end face of the cylindrical separator 116*c* faces the side plate 106. Specifically, the cylindrical separator 116*c* supports the inside and outside catalyst members 202*a,* 202*b* on both outside and inside faces thereof via heat-resistant elastic members 150, 151. Therefore, in this embodiment, it is not necessary to use the packing 20 as in the fourteenth embodiment. In this embodiment, thermal insulating property of the inside catalyst member 202*a* is improved and thermal stress produced by distribution in temperature is decreased. In addition, because the inside and outside catalyst members 202*a,* 202*b* are separately formed, it is easy to control the catalyst properties. The other features and effects are the same as those in the fourteenth embodiment.

Next, the eighteenth embodiment will be explained with reference to FIG. 27. In the fourteenth to seventeenth embodiments, the premixing chamber 116 is integrally formed with the combustion cylinder 101. As opposed to this, in a catalyst combustion apparatus A5 of the eighteenth embodiment, a premixing chamber 216 is separately formed from the combustion cylinder 101.

The premixing chamber 216 has a generally conical bottom portion 216*d,* and a passage 121*a* in which the high-temperature combustion gas flows are defined between the bottom portion 216*d* and the bottom wall 110*a* of the combustion cylinder 101. The passage 121*a* communicates with the exhaust gas chamber 121. Accordingly, as compared to the fourteenth to seventeenth embodiments, the effect of heating the fuel evaporation member 119 by the combustion gas is enhanced, and accordingly the fuel in the premixing chamber 216 is more smoothly vaporized.

Finally the nineteenth embodiment will be described with reference to FIG. 28. A catalyst combustion apparatus A6 in this embodiment has an electric heater 160 in place of using the starting catalyst body 114 as in the fourteenth to eighteenth embodiments. The electric heater 160 is for example a spirally shaped sheath heater holding catalysts on the surface thereof. The electric heater 160 has positive side and negative side electric terminals 161*a* , 161*b* disposed in the bottom wall of the combustion cylinder 101. The electric heater 160 can fill the role of the starting catalyst body 114.

In the fourteenth to nineteenth embodiments, although the specifications of the inside and outside catalyst members are substantially the same as one another, they are formed such that the inside catalyst member is activated at a temperature a lower than that of the outside catalyst member, by increasing the amount or decreasing the average in particulate diameter of the catalysts held in the inside catalyst member compared to the outside catalyst member. Incidentally, the decrease of the average in diameter of the catalysts results in an increase in total surface area of the catalysts. As a result, the combustion rise time is shortened, so that the combustion is stable performed in a lower load region.

Also, in the fourteenth to eighteenth embodiments, the honeycomb 114*a* of the starting catalyst body 114 has a disk shape; however, it may have a ring-like shape as the main catalyst body 102. In this case, the fast-acting property of preheating and vaporizing the air-fuel mixture by the staring catalyst body 114 is slightly reduced, however a pressure loss of the air-fuel mixture flowing in the starting catalyst body 114 can be reduced so that the driving force for the air pump 107 is decreased.

In the present invention, not only liquid fuel such as the kerosene but also gas fuel such as natural gas may be employed.

Although the present invention has been fully described in connection with the preferred embodiments thereof with reference to the accompanying drawings, it is to be noted that various changes and modifications will become apparent to those skilled in the art. Such changes and modifications are to be understood as being included within the scope of the present invention as defined in the appended claims.

What is claimed is:

1. A catalyst combustion apparatus comprising:

a catalyst body for catalytically burning a mixture of fuel and air, said catalyst body being formed in a ring shape to have a through-hole at a center thereof;

fuel supply means disposed at one end side of said catalyst body, for supplying fuel;

air supply means disposed at said one end side of said catalyst body, for supplying air for combustion;

a combustion cylinder for containing said catalyst body and forming a premixing chamber at the other end side of said catalyst body, said premixing chamber being for mixing fuel supplied from said fuel supply means and passing through said through-hole and air supplied from said air supply means and passing through said through-hole, said premixing chamber being also for changing a direction of said mixture of the fuel and the air such that said mixture flows through said catalyst body from the other end side toward the one end side;

means for circulating a part of exhaust gas having passed through said catalyst body into the air supplied from said air supply means; and a starting catalyst body having an electric conductivity and disposed in a portion closer to said premixing chamber than said ring-shaped catalyst body, said starting catalyst body being electrified from the outside and generating heat as an electric resistor while being electrified.

2. A catalyst combustion apparatus according to claim 1, further comprising:

an exhaust gas mixing cylinder disposed in said through-hole, for mixing the air and a part of the exhaust gas having passed through said catalyst body.

3. A catalyst combustion apparatus according to claim 1, further comprising:

a primary nozzle disposed adjacent to the one end side of said catalyst body and having a throttle portion for throttling a flow of the air, wherein a part of the exhaust gas having passed through said catalyst body is circulated into the air by a decompressing action of said throttle portion.

4. A catalyst combustion apparatus according to claim 3, wherein said throttle portion is disposed at a central portion of said exhaust gas mixing cylinder to circulate a part of the exhaust gas having passed through said catalyst body from an outer circumferential side of said throttle portion into the air.

5. A catalyst combustion apparatus according to claim 4, further comprising:

a secondary nozzle formed in a ring shape and disposed at an outer circumferential side of said throttle portion, for circulating a part of the exhaust gas having passed through said catalyst body into the air.

6. A catalyst combustion apparatus according to claim 1, wherein, said fuel is liquid, and said catalyst combustion apparatus further comprises a fuel absorber disposed in said premixing chamber, for absorbing and evaporating the liquid fuel.

7. A catalyst combustion apparatus according to claim 1, wherein, said ring-shaped catalyst body is axially divided into a plurality of catalyst bodies, and an amount of catalyst carried by said catalyst body being closer to said premixing chamber is larger than that carried by said catalyst body being more away from said premixing chamber.

8. A catalyst combustion apparatus according to claim 1, wherein, said combustion cylinder forms therein an exhaust gas chamber at the one side of said catalyst body, for receiving the exhaust gas having passed through said catalyst body, and a heat exchange is performed between the exhaust gas in said exhaust gas chamber and the air supplied from said air supply means.

9. A catalyst combustion apparatus according to claim 1, further comprising an insulator disposed around said premixing chamber and said catalyst body.

10. A catalyst combustion apparatus according to claim 1, wherein, at the time of starting the combustion operation, said electrically conductive starting catalyst body is electrified, when a predetermined time period elapsed since said starting catalyst body is electrified, a supply of the fuel and the air is started with a small amount, and when a temperature of the exhaust gas having passed through said ring-shaped catalyst body and said starting catalyst body reaches a first predetermined value, a supply amount of the fuel and the air is increased continuously or stepwise, and when the temperature of the exhaust gas having passed through said two catalyst bodies reaches a second predetermined value higher than said first predetermined value, the supply of electricity to said starting catalyst body is stopped.

11. A catalyst combustion apparatus according to claim 10, wherein, said ring-shaped catalyst body is electrically conductive and being electrified from the outside, said ring-shaped catalyst body being electrified while said starting catalyst body is electrified, so that said two catalyst bodies generate heat as electric resistors.

12. A catalyst combustion apparatus according to claim 1, wherein fuel supplied from said fuel supply means enters said premixing chamber after passing through said starting catalyst body.

13. A catalyst combustion apparatus according to claim 1, wherein:

said fuel is liquid;

said fuel supply means includes a fuel nozzle having characteristics in which a fuel spray angle increases in accordance with an increase in a flow amount of the liquid fuel; and when the flow amount of the liquid fuel is high, the spray angle of the fuel to be sprayed from said fuel nozzle is increased so that the sprayed fuel from said fuel nozzle flows toward an inner wall surface of said through-hole of said catalyst body.

14. A catalyst combustion apparatus according to claim 13, further comprising a fuel absorber mounted on an inner wall surface of said through-hole of said catalyst body, for absorbing and evaporating the liquid fuel.

15. A catalyst combustion apparatus according to claim 1, wherein:

said fuel is liquid;

said catalyst combustion apparatus further comprises:

a deflecting plate mounted on an inner wall surface of said through-hole of said catalyst body, for deflecting a flow of the liquid fluid supplied from said fuel supply means; and when the flow amount of the liquid fuel is high, the fuel supplied from said fuel supply means is deflected by said deflecting plate toward an inner wall face of said through-hole of said catalyst body.

16. A catalyst combustion apparatus according to claim 15, further comprising a fuel absorber mounted on an inner wall surface of said through-hole of said catalyst body, for absorbing and evaporating the liquid fuel.

17. A catalyst combustion apparatus according to claim 1, wherein said ring-shaped catalyst body is electrically conductive and capable of being electrified while said starting catalyst body is electrified, so that said two catalyst bodies generate heat as electric resistors.

18. A catalyst combustion apparatus according to claim 1, further comprising:

a heating heat transfer medium contained at the one end side of said catalyst body; and a heat exchanger disposed at the one end side of said catalyst body, for exchanging heat with the exhaust gas having passed through said catalyst body to heat said heating heat transfer medium.

19. A catalyst combustion apparatus according to claim 1, further comprising:

a heating heat transfer medium contained around said combustion cylinder; and a heat exchanger disposed around said combustion cylinder for exchanging the heat with the exhaust gas having passed through said catalyst body to heat said heating heat transfer medium.

20. A catalyst combustion apparatus according to claim 1, wherein:

said catalyst body is composed of a first catalyst member having said through-hole at a center thereof and a second catalyst member disposed on an outer circumferential side of said first catalyst member; and said mixture of fuel and air mixed in said premixing chamber first flows in a first one of said first catalyst member and said second catalyst member in a first direction and then flows in a second one of said first catalyst member and said second catalyst member in a second direction opposed to the first direction.

21. A catalyst combustion apparatus according to claim 20, wherein:

said first one of said first catalyst member and said second catalyst member is said first catalyst member; and said second one of said first catalyst member and said second catalyst member is said second catalyst member.

22. A catalyst combustion apparatus according to claim 21, wherein said premixing chamber communicates with said first catalyst member and is isolated from said second catalyst member at the other end side of said catalytic body.

23. A catalyst combustion apparatus according to claim 21, wherein said mixture of fuel and air is discharged from said second catalyst member as an exhaust gas into an exhaust gas chamber after passing through said first and second catalyst members, said exhaust gas chamber being isolated from said premixing chamber and having an outlet for discharging said mixture.

24. A catalyst combustion apparatus according to claim 23, further comprising a heat exchanger disposed in said exhaust gas chamber, said heat exchanger transporting thermal medium which exchanges heat with said exhaust gas.

25. A catalyst combustion apparatus according to claim 21, wherein a volume of said second catalyst member is larger than a volume of said first catalyst member.

26. A catalyst combustion apparatus according to claim 21, wherein said premixing chamber has a wall that prevents said mixture of said air and said fuel from entering said second catalyst member directly from said premixing chamber.

27. A catalyst combustion apparatus according to claim 21, wherein said first and second catalyst members are separated from one another by a wall defining said premixing chamber.

28. A catalyst combustion apparatus according to claim 21, wherein said first and second catalyst members are integral with one another.

29. A catalyst combustion apparatus according to claim 21, wherein said first and second catalyst members are separated from one another.

30. A catalyst combustion apparatus according to claim 21, wherein said mixture is discharged from said second catalyst member as an exhaust gas into an isolated passage that is provided around said premixing chamber in said combustion cylinder.

31. A catalyst combustion apparatus according to claim 21, further comprising a heat exchanger disposed at an outlet side of said second catalyst member for exchanging heat between thermal medium and said mixture discharged from said second catalyst member as an exhaust gas.

32. A catalyst combustion apparatus according to claim 21, wherein:

said first and second catalyst members respectively hold catalysts thereon; and a catalyst amount of said first catalyst member is larger than a catalyst amount of said second catalyst member.

33. A catalyst combustion apparatus according to claim 21, wherein:

said first and second catalyst members respectively hold thereon catalysts made of noble metal; and an average diameter of catalysts of said first catalyst member is smaller than an average diameter of catalysts of said second catalyst member.

34. A catalyst combustion apparatus according to claim 21, wherein said mixture is discharged from said first catalyst member into a turning chamber at an opposite side thereof with respect to said premixing chamber, said turning chamber communicating with said through-hole through a return passage for returning part of said mixture discharged from said first catalyst member to said through-hole.

* * * * *